US005807663A

United States Patent [19]

Funakubo et al.

[11] Patent Number: 5,807,663

[45] Date of Patent: Sep. 15, 1998

[54] SILVER HALIDE EMULSION AND PHOTOSENSITIVE MATERIAL

[75] Inventors: Takeshi Funakubo; Yoichi Maruyama, both of Minami-Ashigara, Japan

[73] Assignee: Fuji Photo Film Co., Ltd., Kanagawa, Japan

[21] Appl. No.: 582,359

[22] Filed: Jan. 5, 1996

[30] Foreign Application Priority Data

Jan. 6, 1995 [JP] Japan ..... 7-016429

[51] Int. Cl.[6] ..... G03C 1/035; G03C 1/015; G03C 1/043

[52] U.S. Cl. ..... 430/567; 430/569

[58] Field of Search ..... 430/567, 569

[56] References Cited

U.S. PATENT DOCUMENTS 5,132,203 7/1992 Bell et al. ..... 430/567
5,147,771 9/1992 Tsaur et al. ..... 430/567
5,439,787 8/1995 Yamanouchi et al. ..... 430/567
5,498,516 3/1996 Kikuchi et al. ..... 430/567

FOREIGN PATENT DOCUMENTS 63-280241 11/1988 Japan .
3-189642 8/1991 Japan .

*Primary Examiner*—Mark F. Huff
*Attorney, Agent, or Firm*—Birch, Stewart, Kolasch & Birch, LLP

[57] ABSTRACT

A silver halide emulsion comprising silver halide grains. In them, 60 or more percent of the total area of all silver halide grains are occupied by tabular silver halide grains having a circle equivalent diameter of 0.6 $\mu$m or less, an aspect ratio of 1.5 or more, and having dislocation lines substantially localized only in the fringe portions thereof. Also, 50 or more percent of the number of all silver halide grains are occupied by tabular silver halide grains having 10 or more dislocation lines per grain. In addition, the surface silver iodide content of all silver halide grains is 3 mol % or less when analyzed by X-ray photoelectric spectroscopy (XPS).

18 Claims, 1 Drawing Sheet

200 nm
(x 150, 000)

200 nm
(x 150, 000)

SILVER HALIDE EMULSION AND PHOTOSENSITIVE MATERIAL

BACKGROUND OF THE INVENTION

1. Field of the Invention

The present invention relates to a silver halide emulsion silver and a photosensitive material, and in particular to a halide emulsion which provides a silver halide photosensitive material having excellent sensitivity, granularity, and mar resistance; and a photosensitive material containing the same.

2. Description of Related Art

In recent years, requirements for silver halide emulsions for photographic use have become increasingly hard. Examples of such requirements include toughness such as mar resistance as well as high sensitivity and excellent granularity.

Manufacturing methods and utilization techniques for tabular silver halide grains or tabular grains are disclosed, for example, in U.S. Pat. Nos. 4,434,226, 4,439,520, 4,414,310, 4,433,048, 4,414,306, and 4,459,353. Known advantages of tabular silver halide grains include improvement in sensitivity including improved color sensitization efficiency through the use of sensitizing dyes, an improved relationship between sensitivity and granularity, improved sharpness derived from optical properties unique to tabular grains, and improved covering power.

JP-A-63-220,238 and JP-A-1-201,649 disclose tabular silver halide grains into which dislocation lines have been introduced intentionally. A dislocation line is a lattice defect in the form of a line formed, on a slip plane of a crystal along the boundary between a region where slipping has occurred and a region where slipping has not yet occurred.

The above publications show that tabular grains to which dislocation lines have been introduced have excellent photographic characteristics such as sensitivity and reciprocity, as opposed to tabular grains without dislocation lines. They also show that using tabular grains with dislocation lines result in excellent sharpness and granularity.

JP-A-1-329,231 states that a highly sensitive silver halide emulsion with improved granularity, gradation, and antifogging properties can be obtained from tabular silver halide grains which have not less than 10 dislocation lines per grain at a fringe portion thereof.

In order to attain further increase in sensitivity of silver halide grains, it is preferable in terms of homogeneity among grains, efficient chemical sensitization, and concentration of latent image forming sites that dislocation lines be introduced at a high density in a localized state within each grain and among grains.

However, according to conventional techniques for introducing dislocation lines as described in JP-A-3-189,642, attaining high-density dislocation lines is incompatible with the localization of dislocation lines.

That is, an attempt to introduce dislocation lines at the fringe portion of tabular grains at a higher density caused unexpected occurrence of dislocation lines even in the main plane portion of tabular grains, thereby failing to introduce homogeneous high-density dislocation lines within individual grains and among grains.

According to JP-A-62-18,555, JP-A-62-99,751, JP-A-62-115,435, and JP-A-63-280,241, using tabular grains with a circle equivalent diameter of 0.6 μm or smaller improves sharpness.

However, the inventions disclosed in these publications are not based on sufficient study of the introduction of dislocation lines. Particularly, for small-size grains having a circle equivalent diameter of 0.6 μm or smaller and an aspect ratio of 1.5 or more, it was impossible to highly localize dislocation lines at a high density in a fringe portion. Also, no consideration was given to an attempt to maintain the distribution and density of silver iodide within tabular grains in a state conducive to improving sensitivity.

SUMMARY OF THE INVENTION

An object of the present invention is to highly localize dislocations at a high density in the fringe portion of small-size silver halide grains and to attain homogeneity of dislocation lines both within individual grains and among grains. Another object of the present invention is to give sufficient consideration to the distribution of silver iodide in thus prepared grains so as to improve sensitivity. That is, an object of the present invention is to provide a silver halide emulsion having excellent characteristics, which cannot be provided by the previous techniques, such as good sensitivity, excellent pressure characteristics, and low fog; and to provide a photosensitive material including the silver halide emulsion.

The present invention has been accomplished so as to attain the above objects.

The present invention provides a silver halide emulsion (I) comprising silver halide grains wherein 60 or more percentage of the total area of all silver halide grains are occupied by tabular silver halide grains having a circle equivalent diameter of 0.6 μm or less, an aspect ratio of 1.5 or more, and having dislocation lines substantially localized only in the fringe portions thereof;

50 or more percentage of the number of all silver halide grains are occupied tabular silver halide grains having 10 or more dislocation lines per grain; and the surface silver iodide content of all silver halide grains is 3 mol % or less when analyzed by X-ray photoelectric spectroscopy (XPS).

The invention also provides a photosensitive material comprising at least one of blue sensitive, green sensitive, and red sensitive silver halide emulsion layers, at least one layer present, including the silver halide emulsion (I).

Preferable embodiments of the silver halide emulsion of the present invention include the following silver halide emulsions (II), (III), and (IV):

(II): A silver halide emulsion defined by (I) above, wherein the tabular silver halide grains are in a multilayer structure formed of phases with different silver iodine contents and wherein a phase with the lower silver iodine content is formed at a pAg of 8.5 or less after a phase with the higher silver iodine content is formed.

(III): A silver halide emulsion defined by (I) or (II) above, wherein the tabular silver halide grains are formed in the presence of a polyalkylene oxide block copolymer.

(IV): A silver halide emulsion defined by (I), (II) or (III) above, wherein the tabular silver halide grains are formed in the presence of an iodide ion releasing agent and a regulator for regulating the release rate of iodide ions.

In the present invention, tabular silver halide grains having a circle equivalent diameter of 0.6 μm or less and an aspect ratio of 1.5 or more account for not less than 60% of the total areas of all silver halide grains. As a result, the emulsion exhibits good sharpness, granularity and other characteristics. Further, in tabular silver halide grain according to the invention, dislocation lines are highly localized at a high density in its fringe portion. That is, high density of dislocation lines is compatible with localization of dislocation lines. This provides high sensitivity, good granularity and gradation, prevention of fog, and the like. Further, both the distribution and density of silver iodide are controlled in tabular silver halide grains. That is, the surface silver iodide content does not exceed a predetermined value, thereby contributing to improved sensitivity.

PREFERRED EMBODIMENTS OF THE INVENTION

Figure 1:
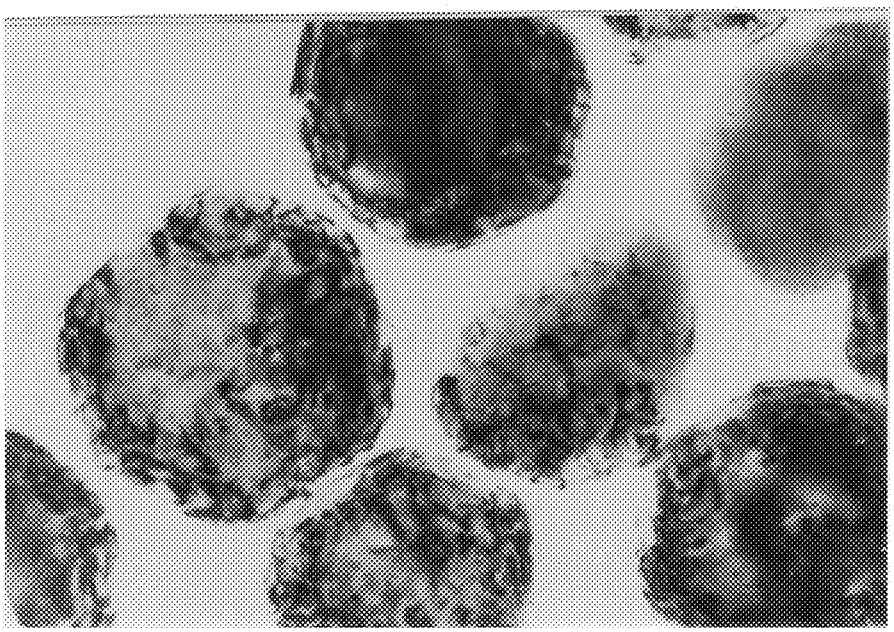
FIG. 1 (Prior Art)
FIG. 1 is an electron micro graph showing the structure of emulsion particles obtained in a comparative example.

The present invention will now be described in detail.

A circle equivalent diameter, as well-known to those skilled in the art, is the diameter of a circle having an area equal to the projected area of a silver halide grain.

According to the present invention, not less than 60% (based on an area) of all halide grains have a circle equivalent diameter of 0.6 $\mu$m or less. An circle equivalent diameter of greater than 0.6 $\mu$m fails to provide good sharpness. Preferably, not less than 60% (based on an area) of all halide grains have an circle equivalent diameter of 0.6 to 0.1 $\mu$m.

In silver halide emulsion of the present invention, not less than 60% (on an area basis) of all silver halide grains have an aspect ratio of 1.5 or more. An aspect ratio of less than 1.5 fails to make the most of advantages of tabular grains (e.g. improved covering power and improved color sensitization efficiency by sensitizing dye).

Preferably, grains having an aspect ratio of 1.5 to 20 account for not less than 60% of all grains.

An aspect ratio is the quotient obtained by dividing the circle equivalent diameter of the projected area of a silver halide grain by the thickness of the grain, and defines the shape of a tabular grain. Tabular grains can be prepared by methods described, for example, in: Cleve, "Photography Theory and Practice (1930)," p. 131; Gutoff, "Photographic Science and Engineering", Vol. 14, 1970, pp. 248–257; U.S. Pat. No. 4,434,226; U.S. Pat. No. 4,414,310; U.S. Pat. No. 4,433,048; U.S. Pat. No. 4,439,520; and UKP2,112,157. Using tabular grains provides improved covering power and other advantages as detailed in U.S. Pat. No. 4,434,226.

It is preferable that the mean aspect ratio of not less than 50% of the total projected area of grains is 1 or more but less than 100. More preferably, the mean aspect ratio is not less than 2 but less than 30, most preferably not less than 3 but less than 25.

Tabular grains may be, for example, triangular, hexagonal, or circular. Preferably, as disclosed in U.S. Pat. No. 4,797,354, tabular grains have six substantially equal sides, or substantially regular hexagon.

According to one method of measuring the aspect ratio, a transmission electron micrograph obtained by a replica method is used to obtain both a circular diameter equivalent to the projected area of an individual grain and the thickness of the grain. The grain thickness is calculated from the length of the shadow of a replica.

A tabular grain, in a specific and precise sense, is a grain having two opposed principal planes. The grain has one twin plane or two or more parallel twin planes. A twin plane is a (111) plane across which ions at all lattice points are symmetrically reflected.

The tabular grain, as viewed from above, is in the shape of a triangle, hexagon, rounded triangle or rounded hexagon, and has parallel outer faces.

The tabular silver halide grains in the present invention typically include silver iodide and at least one among a silver iodide phase, a silver iodobromide phase, a silver chloroiodide phase, and a silver chloroiodobromide phase. Other silver salts, for example, silver rhodanide, silver sulfide, silver selenide, silver carbonate, silver phosphate, and silver salts of organic acids may be included as other grains or as a portion of silver halide grains.

For all tabular grains in the emulsion of the present invention, a preferable silver iodide content ranges from 0.1 to 20 mol %, more preferably from 0.3 to 15 mol %, most preferably from 1 to 10 mol %.

According to the present invention, dislocation lines are localized in the fringe portion of a grain and at a high density as described before. Dislocation lines of silver halide crystal are discussed in various literature including: 1) C. R. Berry, J. Appl. Phys., 27, 639 (1956); 2) C. R. Berry, D. C. Skilman. J. Appl. Phys., 35, 2165 (1964); 3) J. F. Hamilton, Photo. Sci. Eng., 11, 57 (1967); 4) T. Shiozawa, J. Soc. Phot. Sci. Jap., 34, 16 (1971); 5) T. Shiozawa, J. Soc. Phot. Sci. Jap., 35, 213 (1972). The dislocation lines can be analyzed using X-ray or directly observed using a low-temperature transmission electron microscope. A fringe portion discussed herein indicates a peripheral portion of a tabular grain, and specifically a portion outside a point which firstly exceeds or falls below the mean silver iodide content of all grains, when from a grain edge the distribution of silver iodide extending from the grain edge to the grain center is viewed.

When one observes dislocation lines directly using a transmission electron microscope, one places silver halide grains taken out of an emulsion on an observation mesh while taking care not to apply to grains such a pressure that causes dislocation lines therein. The specimen is held in a cooled state to prevent damage (for example printout) due to an electron beam, and then observed.

As grain thickness increases, it becomes more difficult to transmit an electron beam through the grain; a high-voltage type (200 kV or higher for a thickness of 0.25 $\mu$m) electron microscope will provide a sharper image.

For each of tabular grains, the location and number of dislocation lines as viewed in a direction perpendicular to a principal plane can be obtained, from a photo of the grain which was taken through an electron microscope as described above.

One can or cannot discern a dislocation line depending on the angle of inclination of a specimen with respect to an electron beam; therefore, it is necessary to find locations of dislocation lines from photos of the same grain which are taken at as many angles of inclination of the specimen as possible, in order to observe every dislocation line.

A tabular grain having dislocation lines substantially only in the fringe portion thereof (hereinafter, which may also be referred to as fringe dislocation type tabular grain) is a tabular grain which does not include three or more dislocation lines in portions other than its fringe portion, i.e., its principal plane portion. Among high-density dislocation type tabular grains, a tabular grain having three or more dislocation lines in the principal plane portion thereof (hereinafter also referred to as principal plane dislocation type tabular grain) is discriminated from the fringe dislocation type tabular grain. The respective percentages of fringe dislocation type tabular grains and principal plane dislocation type tabular grains in emulsion particles are obtained by directly observing dislocation lines, preferably for at least 200 emulsion particles.

According to the present invention, fringe dislocation type silver halide tabular grains (having a circle equivalent diameter of 0.6 m or less and an aspect ratio of 1.5 or more) account for not less than 60% of the total area of all silver halide grains, preferably not less than 70%, more preferably not less than 80%. When fringe dislocation type tabular grains account for less than 60% of the total area of all silver halide grains, dislocation lines cannot be said to be localized. As a result, such qualities as homogeneity, efficient chemical sensitization, and concentration of latent image sites are not attained.

Preferably, in obtaining the location and number of dislocation lines, four kinds of photos of grains are taken through a high-voltage type electron microscope while an angle of inclination is changed in 5° steps for the same grain.

According to the present invention, tabular silver halide grains having preferably 10 or more dislocation lines per grain account for not less than 50% of the number of all silver halide grains, thereby providing highly dense dislocations. When the tabular grains account for less than 50% of the total number of silver halide grains, granularity, gradation, anti-fog, and the like are not improved sufficiently. The tabular silver halide grains preferably account for not less than 60% of the total number of silver halide grains, more preferably 70% to 100%.

Preferably, tabular silver halide grains having 50 or more dislocation lines, more preferably 100 or more dislocation lines, account for not less than 50% of the number of all silver halide grains.

When dislocation lines exist densely or when dislocation lines exist in an intersecting manner, it may be difficult to count precisely the number of dislocation lines per grain. Even in such cases, dislocation lines can be counted to a rough extent, for example, 10, 20, or 30.

According to the present invention, the overall surface silver iodide content of all the silver halide grains is 3 mol % or less when analyzed by X-ray photoelectric spectroscopy (XPS), preferably 2.5% or less, more preferably 2.5 to 0 mol %.

Usually, when dislocations are introduced, a silver halide layer including silver iodide is formed on a base grain, and silver iodide, silver iodobromide, or silver chloroiodobromide is formed thereon, as will be described later. It is known that even when silver bromide is formed as the outside layer, silver iodobromide exists on the surface of grains due to ooze. In this connection, the present inventors have found that a highly sensitive small-sized tabular plane is obtained when the silver iodobromide content within a grain surface is small. This reason is presumably as follows: when the surface silver iodobromide content is high, desensitization and deterioration in development become more apparent due to dispersion of chemical sensitization nuclei. In the present invention, therefore, the silver iodide content in a grain surface is 3 mol % or less as described above, thereby maintaining a preferable distribution and density of silver iodide.

The grain surface in this invention denotes a region the halogen whose composition can be analyzed by X-ray photoelectric spectroscopy (XPS). Specifically, the grain surface extends from the surface to a depth of approximately 50 angstroms.

The principle of XPS used for analyzing the silver iodide content near the surface of a silver halide grain is described in Jun'ichi Aihara et al, "Electronic Spectroscopy" (Kyoritsu Library 16, Kyoritsu Shuppan, 1978).

According to a typical practice of XPS, Mg-Kα is used as an exciting X-ray, and the intensity of photoelectrons of iodine (I) and silver (Ag) (usually 3d5/2 for I, 3d5/2 for Ag) emitted from silver halide grains prepared in a proper form of specimen is observed.

The silver iodide content of the grain surface, i.e. the percentages of iodine, can be obtained from analytical curves which describe the photoelectron intensity ratio between iodine (I) and silver (Ag) (intensity (I)/intensity (Ag)) and which are prepared using several standard specimens with known iodine contents. For silver halide emulsion, gelatin adsorbing on the surface of silver halide grains should be decomposed and removed using protease or the like before an XPS measurement is initiated.

The silver iodide contents in the core and shell portions of silver halide grains can be measured by an X-ray diffraction method. An application of the X-ray diffraction method to the measurement of silver halide grains is described in H. Hilsche, "Journal of Photographic Science," Vol. 10, 1962, from page 129. When a lattice constant is determined from the halogen composition, peak diffraction occurs at an angle of diffraction which meets Bragg's condition (2dsin=nl)

A method of measurement by X-ray diffraction is detailed in Basic Analytical Chemistry Course 24, "X-ray Analysis" (Kyoritsu Shuppan) and "Guide to X-ray Diffraction" (Rigaku Denki Kabushiki Kaisha). According to a standard measuring method, a diffraction curve of the (220) plane of silver halide is obtained using Cu as a target and K ray of Cu as a radiation source (tube voltage 40 kV, tube current 60 mA). In order to improve resolution of a measuring instrument, it is necessary to select properly the width of slits (a divergent slit, a light receiving slit, etc.), time constant of the instrument, scanning velocity of a goniometer, and recording velocity and also to check accuracy of measurement using a standard specimen such as silicon.

When a curve between diffraction intensities and diffraction angles of the (220) plane of silver halide is obtained using Kβ ray of Cu, it may be possible to definitely detect a diffraction peak corresponding to a high silver iodide phase including 10 to 45 mol % of silver iodide and a diffraction peak corresponding to a low silver iodide phase including silver iodide of a lower content, or impossible to separate the diffraction peaks definitely, due to overlap. A method of analyzing a diffraction curve composed of two diffraction components as above is well known and described, for example, in Experimental Physics Course 11, "Lattice Defect" (Kyoritsu Shuppan). It is also useful to consider the diffraction curve as a Gaussian function or as a Loret function and to analyze it on a curve analyzer of Du Pont.

For silver halide grains in the present invention, the low silver iodide phase and the high silver iodide phase may or may not separate definitely. Preferably, the phases form continuous layers. Even in an emulsion containing two kinds of grains which have different halogen compositions and which do not have mutually definite layered-structure, two peaks appear in the X-ray diffraction described above.

Tabular silver halide grains in the present invention are preferably 0.05 to 1.0 μm thick. A thickness of less than 0.05 μm is not desirable due to deteriorated mar resistance. Also, a thickness of over 1.0 μm is not desirable because advantages of tabular grains are not fully effected.

In silver halide emulsions of the present invention, tabular silver halide grains shaped in a hexagon wherein a length ratio of the longest side to shortest side is between 2 and 1 preferably account for 60% to 100% of the total projected area of all grains in the emulsion, more preferably 70% to 100%, most preferably 90% to 100%.

A method of introducing dislocation lines will be described which have a high density and are localized in the fringe portion of grains having an circle equivalent diameter and an aspect ratio according to the present invention.

According to conventional methods of introducing dislocations, a high silver iodide phase is grown and then a low silver iodide phase is grown. However, when conventional methods known to those skilled in the art are applied to the case of grains of 0.6 $\mu$m or less in circle equivalent diameter and of 1.5 or more in aspect ratio as in the present invention, dislocations have been found to be introduced into a principal plane at a higher rate to result in deterioration in mar resistance, sensitivity, and the like qualities.

The present inventors have found that using techniques described below in an emulsion preparing process allows dislocations to be locally introduced into a group of tabular grains having specified circle equivalent diameter and aspect ratio at the fringe portion thereof at a high density.

(1) To introduce iodine while the reaction rate of iodide ions is being controlled. For example, there are used an iodide ion releasing agent and a regulator for regulating an iodide ion release rate of the iodide ion releasing agent.

(2) To allow a low silver iodide phase to grow while pAg is reduced to 8.5 or less, after a high silver iodide phase has grown.

(3) To form tabular silver halide grains in the presence of a polyalkylene oxide block copolymer. Specifically, a high molecular compound such as polyalkylene oxide block copolymers is rendered present in growing a low silver iodide phase.

Surprisingly, using any two of the above three techniques together is found to give a significantly advantageous effect. Also, using the three techniques in combination is found to give a more significantly one.

Technique (1) will now be described.

To obtain a markedly advantageous effect by using technique (1), grains are formed while iodide ions are being rapidly formed by using the iodide ion releasing agent represented by formula (I).

The iodide ion releasing agent represented by formula (I) partially overlaps a compound which is described in JP-A-2-68538 and used for homogenizing halogen composition in each silver halide grain and among silver halide grains.

Unexpectedly, however, the present inventors have found that as a result of rapidly forming iodide ions in the presence of the iodide ion releasing agent represented by formula (I), silver halide grains having good characteristics are obtained, such as high sensitivity, good granularity and the like.

The iodide ion releasing agents of the present invention represented by the following formula (I) will next be described in detail.

R—I formula (I)

In formula (I), R represents a monovalent organic residue which releases an iodine atom in the form of an iodide ion when it is reacted with a base and/or a neucleophilic reagent.

In formula (I), preferable examples of R include $C_1$–$C_{30}$ alkyl, $C_2$–$C_{30}$ alkenyl, $C_2$–$C_3$ alkynyl, $C_6$–$C_{30}$ aryl, $C_7$–$C_{30}$ aralkyl, $C_4$–$C_{30}$ heterocyclic, $C_1$–$C_{30}$ acyl, carbamoyl, $C_2$–$C_{30}$ alkyl- or aryloxy carbonyl, $C_1$–$C_{30}$ alkyl- or arylsulfonyl, and sulfamoyl.

Among these groups, R is preferably selected from the above groups having 20 or less, more preferably 12 or less, carbon atoms. The range of carbon numbers is determined so in view of solubility and an amount of incorporation.

R is preferably substituted. Examples of preferred substituents include the following (wherein the substituents may be further substituted by other substituents).

A halogen atom (for example, fluorine, chlorine, bromine and iodine), an alkyl group (for example, methyl, ethyl, n-propyl, isopropyl, t-butyl, n-octyl, cyclopentyl, and cyclohexyl), an alkenyl group (for example, allyl, 2-butenyl, and 3-pentenyl), an alkynyl group (for example, propargyl and 3-pentinyl), an aralkyl group (for example, benzyl and phenetyl), an aryl group (for example, phenyl, naphthyl, and 4-methylphenyl), a heterocyclic group (for example, pyridyl, furyl, imidazolyl, piperidyl, and morphoryl), and alkoxy group (for example, methoxy, ethoxy, and butoxy), an aryloxy group (for example, phenoxy and naphthoxy), an amino group (for example, unsubstituted amino, dimethylamino, ethylamino, and anilino), an acylamino group (for example, acetylamino and benzoylamino), a ureido group (for example, unsubstituted ureido, N-methylureido, and N-phenylureido), an urethane group (for example, methoxycarbonylamino and phenoxycarbonylamino), a sulfonylamino group (for example, methylsulfonylamino and phenyl sulfonylamino), a sulfamoyl group (for example, sulfamoyl, N-methylsulfamoyl, and N-phenylsulfamoyl), a carbamoyl group (for example, carbamoyl, diethylcarbamoyl, and phenylcarbamoyl), a sulfonyl group (for example, methylsulfonyl and benzenesulfonyl), a sulfinyl group (for example, methylsulfinyl and phenylsulfinyl), an alkylcarbonyl group (for example, methoxyoxycarbonyl and ethoxycarbonyl), an aryloxycarbonyl group (for example, phenoxycarbonyl), an acyl group (for example, acetyl, benzoyl, formyl, and pivaloyl), an acyloxy group (for example, acetoxy and benzoyloxy) a phosphoric amide group (for example, N,N-diethylphosphoric amide), an alkylthio group (for example, methylthio and ethylthio), an arylthio group (for example, phenylthio), a cyano group, a sulfo group, a carboxyl group, a hydroxy group, and a nitro group.

Examples of more preferred substituents which replace R include a halogen atom, an alkyl group, an aryl group, a 5- or 6-membered heterocyclic group containing at least one of O, N, and S, an alkoxy group, an aryloxy group, an acylamino group, a sulfamoyl group, a carbamoyl group, an alkylsulfonyl group, an alkylsulfonyl group, an arylsulfonyl group, an aryloxycarbonyl group, an acyl group, a sulfo group, a carboxyl group, a hydroxy group, and a nitro group.

Examples of particularly preferred substituents of R are hydroxy, carbamoyl, and lower alkyl- sulfonyl or sulfo (including salts thereof) when they substitute an alkylene group, and sulfo (including salts thereof) when substituted by a phenylene group.

The compounds of formula (I) of the present invention are preferably those represented by the following formula (II) and (III).

The compounds of the present invention represented by formula (II) are next described.

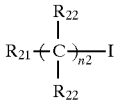

formula (II)

In formula (II), $R_{21}$ represents an electrophilic group and $R_{22}$ represents a hydrogen atom or a group capable of being substituted.

n2 represents an integer of 1–6, and is preferably 1–3, with 1 or 2 being particularly preferred.

The electrophilic group represented by $R_{21}$ is preferably an organic group having a Hammett's value $\sigma_p$, $\sigma_m$, or $\sigma_I$ of greater than 0.

The Hammett's values $\sigma_p$ and $\sigma_m$ are described on page 96 of "Interrelation between Structures and Activities of Chemicals" (1979, published by Nanko-do), and $\sigma_I$ values are described on page 105 of the same literature, from which suitable groups can be selected.

Examples of $R_{21}$ preferably include halogen (for example, fluorine, chlorine, and bromine), a trichloromethyl group, a cyano group, a formyl group, a carboxyl group, a sulfonic acid group, a carbamoyl group (for example, unsubstituted carbamoyl and diethylcarbamoyl), an acyl group (for example, acetyl and benzoyl), an oxycarbonyl group (for example, methoxycarbonyl and ethoxycarbonyl), a sulfonyl group (for example, methanesulfonyl and benzenesulfonyl), a sulfonyloxy group (for example, methanesulfonyl), a carbonyloxy group (for example, acetoxy), a sulfamoyl group (for example, unsubstituted sulfamoyl and dimethylsulfamoyl), and a heterocyclic group (for example, 2-thienyl, 2-benzoxazolyl, 2-benzothiazolyl, 1-methyl-2-benzimidazolyl, 1-tetrazolyl, and 2-quinolyl). The $R_{21}$ groups preferably contain 1 to 20 carbon atoms.

Examples of $R_{22}$ (which is capable of being substituted) are the same as those listed for substituents which substitute R.

It is preferred that half or more than half of a plurality of groups $R_{22}$ contained in a compound of formula (II) be hydrogen atoms. The plurality of groups $R_{22}$ in the molecule may be the same or different.

$R_{21}$ and $R_{22}$ may further be substituted by other groups. Preferable substituents are those listed for the substituents which substitute R.

Also, groups $R_{21}$ and $R_{22}$ or two or more groups $R_{22}$'s may be linked to form 3- or 6-membered rings.

The compounds of the present invention represented by formula (III) are next described.

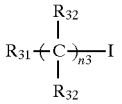

formula (III)

In formula (III), $R_{31}$ represents $R_{33}O$—, $R_{33}S$—, $(R_{33})_2N$—, $(R_{33})_2P$—, or phenyl. $R_{33}$ represents hydrogen, $C_1$–$C_{30}$ alkyl, $C_2$–$C_{30}$ alkenyl, $C_2$–$C_3$ alkynyl, $C_6$–$C_{30}$ aryl, $C_7$–$C_{30}$ aralkyl, or a $C_4$–$C_{30}$ heterocyclic group. The range of carbon numbers is determined so in view of solubility and amount of incorporation.

When $R_{31}$ represents $(R_{33})_2N$— or $(R_{33})_2P$—, the two $R_{33}$'s may be the same or different. $R_{31}$ is preferably $R_{33}O$—.

$R_{32}$ and n3 have the same meaning as $R_{22}$ in formula (II). A plurality of $R_{32}$ may be the same or different. Examples of $R_{32}$ (which is capable of being substituted) include those listed for substituents which substitute R. $R_{32}$ is preferably hydrogen.

$n_3$ is preferably 1, 2, 4, or 5, among which 2 is particularly preferred.

$R_{31}$ and $R_{32}$ may further be substituted. Preferred substituents include those listed substituents which substitute R.

Also, groups $R_{31}$ and $R_{32}$, or two or more groups $R_{32}$'s may be linked to form a ring.

Specific examples of the compounds of the present invention represented by formulas (I), (II), and (III) will next be described. However, the present invention should not be construed as being limited by such specific examples.

$ICH_2COOH$ (1)

$ICH_2CONH_2$ (2)

$ICH_2CN$ (3)

$I(CH_2)_2COOH$ (4)

$I(CH_2)_3COOH$ (5)

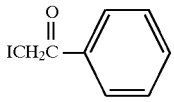

(6)

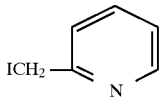

(7)

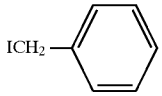

(8)

$I(CH_2)_2SO_3Na$ (9)

$I(CH_2)_2SO_2CH_3$ (10)

$I(CH_2)_2OH$ (11)

$I(CH_2)_3OH$ (12)

$I(CH_2)_4OH$ (13)

$ICH_2CHOH$ (14)
|
$CH_3$ $ICH_2CHOH$ (15)

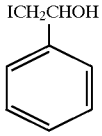

$ICH_2CHCH_2OH$ (16)
|
OH $ICH_2CHCH_2SO_3Na$ (17)
|
OH

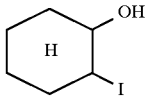

(18)

$ICH_2CHCHCH_2I$ (19)
| |
OHOH

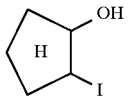

(20)

-continued
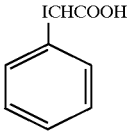
(21)
$I(CH_2)_2SO_2CH_2CONH_2$ (22)
$I(CH_2)_2NH_2$ (23)
$I(CH_2)_2NHSO_2CH_3$ (24)
$I(CH_2)_2NHCOCH_3$ (25)
$I(CH_2)_2OCH_3$ (26)
$I(CH_2)_2SCH_3$ (27)
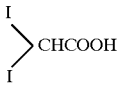
(28)
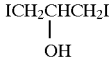
(29)
$I(CH_2)_2SO_2NH_2$ (30)
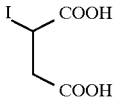
(31)
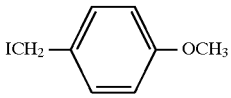
(32)
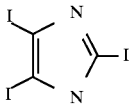
(33)
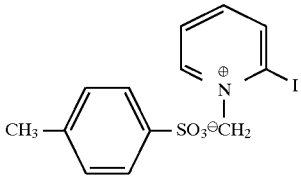
(34)
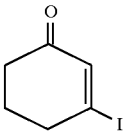
(35)
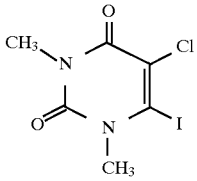
(36)
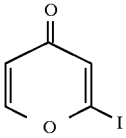
(37)
-continued
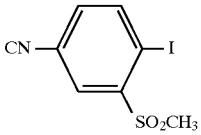
(38)
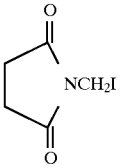
(39)
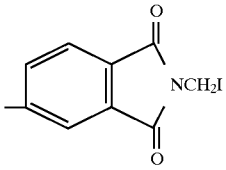
(40)
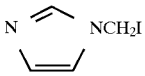
(41)
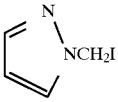
(42)
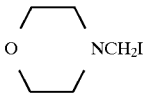
(43)
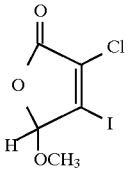
(44)
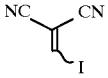
(45)
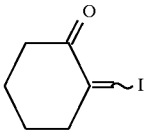
(46)
$I(CH_2)_5COOH$ (47)
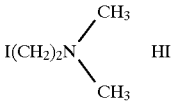
(48)
$I(CH_2)_2N(CH_3)SO_2CH_3$ (49)
$I(CH_2)_2OCOCH_3$ (50)
$I(CH_2)_2N(CH_3)COCH_3$ (51)
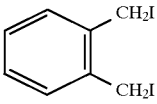
(52)

-continued (53)

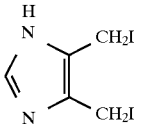

(54)

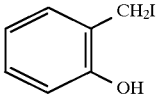

(55)

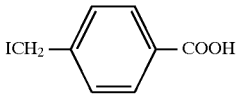

(56)

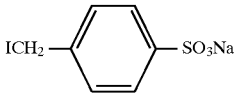

(57)

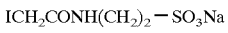

(58)

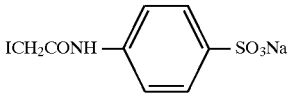

(59)

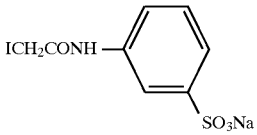

(60)

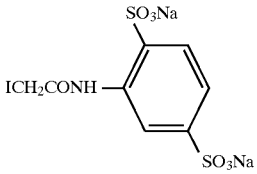

(61)

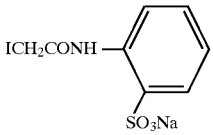

(62)

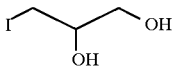

(63)

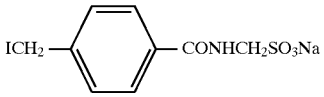

(64)

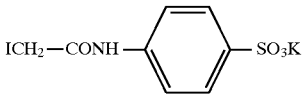

(65)

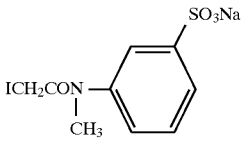

(66)

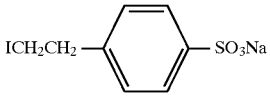

-continued (67)

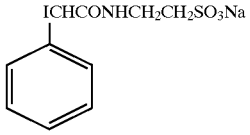

(68)

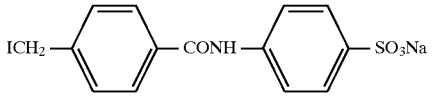

(69)

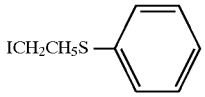

The iodide ion releasing agents can be synthesized with reference to the processes described in the following references.

J. Am. Chem. Soc., 76, 3227-8 (1954); J. Org. Chem., 16, 798 (1951), Chem. Ber., 97, 390 (1964); Org. Synth., V. 478 (1973); J. Chem. Soc., 1951, 1851; J. Org. Chem., 19, 1571 (1954); J. Chem. Soc., 1952, 142; J. Chem. Soc., 1955, 1383, Angew, Chem., Int. Ed., 11, 229 (1972); and Chem. Commu., 1971, 1112.

Iodide ion releasing agents release iodide ions when they are reacted with iodide ion release regulators (bases and/or nucleophilic reagents). Preferred examples of nucleophilic reagents include the following chemical species.

Hydroxide ions, sulfite ions, hydroxylamines, thiosulfate ions, metabisulfite ions, hydroxam acids, oxims, dihydomxy benzenes, mercaptans, sulfinic acids, carboxyl acids, ammonia, amines, alcohols, ureas, thioureas, phenols, hydrazines, hydrazides, semicarbazides, phosphines, and sulfides.

In preparing the emulsion of the present invention, the release rate and timing of iodide ions can be controlled by controlling the concentrations and manners of addition of a base, or nucleophilic reagent, as well as the temperature of the reaction liquid. Preferable examples of the base include alkali hydroxides.

It is preferred that an iodide ion re releasing agent and an iodide ion release regulator used for rapidly producing iodide ions be used in a concentration of from $1\times10^{-7}$ to 20M, more preferably from $1\times10^{-5}$ to 10M, even more preferably from $1\times10^{-4}$ to 5M, and particularly preferably from $1\times10^{-3}$ to 2M.

Concentrations in excess of 20M are not preferable since the amounts of addition of the iodide ion releasing agent and iodide ion release regulator, which are large molecules, become excessively higher than the capacity of a grain forming vessel.

Amounts less than $1\times10^{-7}$ are not preferable, either, which reduces the rate of reaction which releases iodide ions, to make it difficult to produce iodide ion releasing agents rapidly.

The temperature preferably ranges from 30° to 80° C., more preferably from 35° to 75° C., and particularly preferably from 35° to 60° C.

At high temperatures over 80° C., the rate of iodide ion releasing reaction generally becomes very fast. At low temperatures below 30° C., the rate becomes very slow. Thus, both cases are not preferable as conditions are restricted.

In manufacturing the emulsion of the present invention, if a base is used when iodide ions are released, changes in liquid pH may be used.

The pH for controlling the release rate and timing of iodide ions is preferably 2–12, more preferably 3–11, even more preferably 5–10, and particularly preferably 7.5–10.0, after pH has been adjusted. Even under neutral conditions of pH 7, hydroxide ions in relation to the ionic product of water act as an iodide ion release regulator.

A nucleophilic reagent and a base may be used in combination. In this case, pH may be controlled within the above range(s) in order to control the release rate and timing for releasing iodide ions.

The amount of iodide ions released from the iodide ion releasing agent is preferably from 0.1 to 20 mol %, more preferably from 0.3 to 15, and particularly preferably from 1 to 10 mol %, of the total amount of silver halide. The amount may be determined depending on the purpose. If 20 mol % is exceeded, developing speed generally drops, which is not preferable.

When iodine atoms are released in the form of iodide ions from iodide ion releasing agents, all the iodine atoms may be released or a portion of iodine atoms may remain undecomposed.

The release rate of iodide ions from iodide ion releasing agents is next described.

In order to introduce dislocation lines at a high density, it is preferable that a silver halide phase containing silver iodide is formed at the edges of tabular grains, while iodide ions are produced rapidly. If the rate of supplying iodide ions is too slow, or in other words, too much time is spent on forming a silver iodide-containing silver halide phase, the silver iodide-containing silver halide phase is re-dissolved, thereby reducing the density of dislocation lines. On the other hand, a slow supply of iodide ions does not cause localization (uneven distribution) of iodide ions. Thus, a slow supply is preferable for introducing dislocation lines uniformly within grains and among grains.

Accordingly, it is important that iodide ions are produced rapidly but in a manner that would not cause localization (uneven distribution). The probable reason why a region which includes a great localization of iodide ions is produced is as follows. When an iodide ion releasing agent or an iodide ion release regulator used along with the releasing agent is added to a reaction liquid in a grain forming vessel, an iodide ion release reaction proceeds too fast, for the uneven concentration of an additive which occurs locally in the vicinity of the feed port.

The time required for depositing released iodide ions onto host grains is very short. Grains grow in the region close to the feed port having a great localization of iodide ions, to cause uneven grain growth among grains. Therefore, an iodide ion release rate must be selected so that localization of iodide ions does not occur.

In conventional methods (for example, methods in which an aqueous potassium iodide solution is added), even though a diluted potassium iodide solution or the like is added, reduction in localization of iodide is limited. This is because iodide ions are added in their free state. Thus, it is difficult to form grains uniformly by conventional methods without unevenness within individual grains and among grains. However, by using the present invention, which is capable of controlling the iodide ion release rate, localization of iodide ions can be reduced relative to conventional methods.

The present inventors thought that conventional iodide ion supplying methods which cause great localization of iodide ions to introduce dislocations into tabular grains cannot uniformly introduce highly dense dislocations within grains and among grains in an area substantially limited only to fringe portions. The present inventors tried to introduce dislocations into tabular grains using a method which produces iodide ions rapidly and which generates reduced localization of iodide ions. As a result, it has been found that, by using the present method, dislocation lines can be introduced locally in fringe portions of tabular grains while maintaining a high density, and that dislocations can be distributed uniformly within and among grains.

As described above, the iodide ion release rate can be determined by controlling temperature and concentration of iodide ion releasing agents and iodide ion release regulators, and is selected in accordance with purposes.

Preferably, an iodide ion release rate is such that 100 to 50 percentage of the total weight of an iodide ion releasing agent in a reaction liquid charged in a grain forming vessel complete releasing iodide ions for a period of from one second to 180 continuous seconds, more preferably 120 seconds, and particularly preferably 60 seconds.

In this specification, the term "180 continuous seconds" means 180 seconds during which iodide ion release reaction continues. The iodide ion release time may be measured from any point of time during the continuous reaction.

If the iodide ion release reaction is repeated in two or more stages, the iodide ion release rate may be obtained from the iodide ion releasing agent which is present in the reaction liquid at a certain time which is counted from any point of time during the first iodide ion release reaction stage or during the second or subsequent iodide ion release reaction stage.

If a period of 180 seconds is exceeded, generally the release rate is slow. On the other hand, a time period shorter than 1 second causes an excessively fast release rate. In both cases, reaction conditions are limited. If the amount of the iodide ion releasing agent which completes the release of iodide ions within the prescribed time is less than 50%, the same problems are encountered.

More preferable iodide ion release rates are such that 100 to 70% (even more preferably 100 to 80%, and particularly preferably 100 to 90%) of the iodide ion releasing agent in a reaction liquid placed in a grain forming vessel complete releasing iodide ions within 180 continuous seconds.

If the reaction which rapidly generates iodide ions is substantially a secondary reaction which proceeds in proportion to concentrations of an iodide ion releasing agent and an iodide ion release regulator (in water, 40° C.), it is preferred that the secondary reaction rate constant be from 1,000 to $5\times10^{-3}$ ($M^{-1}\cdot sec^{-1}$), more preferably from 100 to $5\times10^{-2}$ ($M^{-1}\cdot sec^{-1}$), and particularly preferably from 10 to 0.1 ($M^{-1}\cdot sec^{-1}$).

"Substantially a secondary reaction" means that the coefficient of correlation is from 1.0 to 0.8. Under a condition where the concentration of the iodide ion releasing agent was from $10^{-4}$ to $10^{-5}$M, the concentration of the iodide ion release regulator was from $10^{-1}$ to $10^{-4}$M, and at 40° C. in water, and under a reaction conditions which may be regarded as a quasi-primary reaction, secondary reaction rate constants k ($M^{-1}\cdot sec^{-1}$) were measured. Typical values are as follows.

| Compound No. | Iodide ion release regulator | k |
|---|---|---|
| 11 | Hydroxide ions | 1.3 |
| 1 | Sulfite ions | less than $1 \times 10^{-3}$ |
| 2 | " | 0.29 |
| 58 | " | 0.49 |
| 63 | " | 1.5 |
| 22 | Hydroxide ions | 720 |

When k is in excess of 1,000, the release rate is too great to be controlled, whereas when k is not more than $5\times10^{-3}$, the release rate is too slow to obtain the effects of the present invention.

Iodide ions are preferably controlled in the following manner.

pH, concentration of a nucleophilic substance, temperature and the like are changed. In general cases, pH is shifted from low to high, so that iodide ions are uniformly released, from the uniformly distributed iodide ion releasing agents which have been added into a reaction liquid charged in a grain forming vessel, in a controlled manner throughout the entire reaction liquid.

When iodide ions are released, it is preferred that an alkali agent for elevating the pH and a nucleophilic substance used in combination be added under conditions where the iodide releasing agent is distributed uniformly.

Next, technique (2) is described.

The technique (2) can be performed by reducing the value pAg to 8.5 or less to form a silver halide shell (with a low silver iodide content phase) outside a high silver iodide content phase which has been formed in edge portions of each grain serving as substrates.

When the high silver iodide content phase is formed, pAg is preferably not more than 8.0, and more preferably in the range of 6.0 to 8.0.

The pAg in a solution is represented by a numerical figure obtained by multiplying the logarithm of the concentration of silver ions by −1. pAg is determined by routine methods known in the art.

The aforementioned technique (3) will next be described.

A description will be made of the polyalkylene oxide block copolymers which can be used in the present invention.

The polyalkylene oxide block copolymers are nonionic surfactants, each containing at least one hydrophilic unit and at least one hydrophobic unit. They are described, for example, in I. R. Schmolka, "A Review of Block Polymer surfactants", J. Am. Oil Chem. Soc., 54 (3), 1977, pp. 110–118, A. S. Davidsohn and B. Milwidsky, "Synthetic Detergents", Johen Wiley & Sons, N.Y., 1987 pp. 29–40, and EP-B-514,742.

A first preferable structure of the copolymer is represented by the following formula (IV):

O1—W1—O1 formula (IV)

wherein O1 is a hydrophobic alkylene oxide block terminal and W1 is a hydrophilic alkylene oxide block serving as a linking moiety. W1 accounts for 4–96% by weight. The molecular weight of the copolymer ranges from 760 to 16,000.

In formula (IV), O1 is preferably represented by a recurring unit of the following formula:

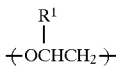

wherein $R^1$ is a hydrophobic group such as a $C_1$–$C_{10}$ fatty hydrocarbon group or a $C_6$–$C_{10}$ aryl group such as phenyl or naphthyl.

In formula (IV), W1 is preferably represented by a recurring unit of the following formula:

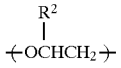

wherein $R^2$ is a hydrogen atom or a hydrophilic group in which the fatty hydrocarbon group $R^1$ is substituted by at least one polar group such as a hydroxyl group and/or a carboxyl group.

Among the compounds of formula (IV), the following compound A is particularly preferred.

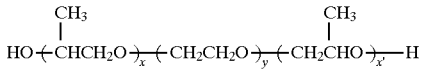

compound A wherein x and x' both fall in the range from 6 to 120 and y is from 2 to 300.

A second preferable structure of the copolymer is represented by the following formula (V).

W2—O2—W2 formula (V)

wherein W2 is a hydrophilic alkylene oxide block terminal moiety and O2 is a hydrophobic alkylene oxide block terminal serving as a linking moiety. O2 accounts for 4–96% by weight. The molecular weight of the copolymer ranges from 1,060 to 36,000.

In formula (V), O2 is preferably represented by a recurring unit of the following formula:

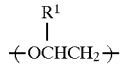

wherein $R^1$ is a hydrophobic group such as a $C_1$–$C_{10}$ fatty hydrocarbon group or a $C_6$–$C_{10}$ aryl group such as phenyl or naphthyl.

In formula (V), W2 is preferably represented by a recurring unit of the following formula:

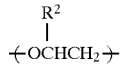

wherein $R^2$ is a hydrogen atom or a hydrophilic group in which the fatty hydrocarbon group $R^1$ is substituted by at least one polar group such as a hydroxyl group and/or a carboxyl group.

Among the compounds of formula (V), the following compound is particularly preferred.

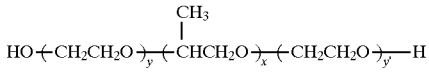

wherein x and x' both fall in the range from 13 to 490 and y is from 1 to 320.

A third preferable structure of the copolymers which may be used in the present invention is represented by the following formula (VI):

$(H—W3—O3\rightarrow)_2—L\leftarrow O3—W3—H)_z$ formula (VI)

wherein W3 is a hydrophilic alkylene oxide block terminal and O3 is a hydrophobic alkylene oxide block. L is an amine or diamine serving as a linking moiety. z is 1 or 2. O3 accounts for 4–96% by weight. The molecular weight of the copolymer ranges from 1,100 to 60,000.

Among the compounds of formula (VI), the following structure is also preferred.

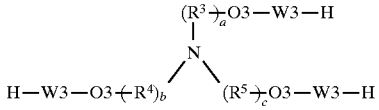

wherein W3 is a hydrophilic alkylene oxide block terminal and O3 is a hydrophobic alkylene oxide block. $R^3$, $R^4$, and $R^5$ are respectively $C_1$–$C_{10}$ fatty hydrocarbons serving as a linking moiety. a, b, and c are each independently 0 or 1.

Among the compounds of formula (VI), the following structure is also preferred.

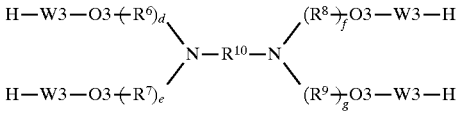

wherein W3 is a hydrophilic alkylene oxide block terminal and O3 is a hydrophobic alkylene oxide block. $R^6$, $R^7$, $R^8$, $R^9$, and $R^{10}$ are respectively $C_1$–$C_{10}$ fatty hydrocarbons serving as a linking moiety. d, e, f, and g are each independently 0 or 1.

In formula (VI), it is preferred that O3 be a recurring unit represented by the following formula:

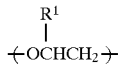

wherein $R^1$ is a hydrophobic group such as a $C_1$–$C_{10}$ fatty hydrocarbon group and a $C_6$–$C_{10}$ aryl group such as phenyl and naphthyl.

In formula (VI), it is preferred that W3 be a recurring unit represented by the following formula:

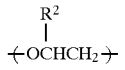

wherein $R^2$ is a hydrogen atom or a hydrophilic group in which the fatty hydrocarbon group $R^1$ is substituted by at least one polar group such as a hydroxyl group and/or a carboxyl group.

A fourth preferable structure of the copolymers which may be used in the present invention is represented by the following formula (VII):

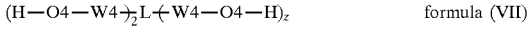

formula (VII)

wherein O4 is a hydrophobic alkylene oxide block terminal and W4 is a hydrophilic alkylene oxide block. L is an amine or diamine serving as a linking moiety. z is 1 or 2. W4 accounts for 4–96% by weight. The molecular weight of the copolymer ranges from 1,100 to 50,000.

Among the compounds of formula (VII), the following structure is particularly preferred:

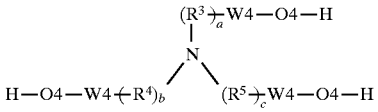

wherein O4 is a hydrophobic alkylene oxide block terminal and W4 is a hydrophilic alkylene oxide block. $R^3$, $R^4$, and $R^5$ are respectively $C_1$–$C_{10}$ fatty hydrocarbons serving as a linking moiety. a, b, and c ire each independently 0 or 1.

Among the compounds of formula (VII), the following structure is also formula:

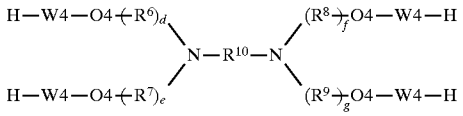

wherein O4 is a hydrophobic alkylene oxide block terminal and W4 is a hydrophilic alkylene oxide block. $R^6$, $R^7$, $R^8$, $R^9$, and $R^{10}$ are respectively $C_1$–$C_{10}$ fatty hydrocarbons serving as a linking moiety. d, e, f, and g are each independently 0 or 1.

In formula (VII), it is preferred that O4 be a recurring unit represented by the following formula.

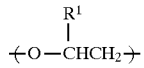

wherein $R^1$ is a hydrophobic group such as a $C_1$–$C_{10}$ fatty hydrocarbon group and a $C_6$–$C_{10}$ aryl group such as phenyl and naphthyl.

In formula (VII), it is preferred that W4 be a recurring unit represented by the following formula:

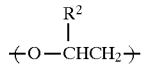

wherein $R^2$ is a hydrogen atom or a hydrophilic group in which the fatty hydrocarbon group $R^1$ is substituted by at least one polar group such as a hydroxyl group and/or a carboxyl group.

Any one of the above techniques (1) through (3) can produce dislocations which are highly dense and highly localized in the fringe portions as defined by the present invention. However, it has been found that when any two of the techniques are combined, surprising effects can be obtained, and that when three of them are all combined, more surprising effects can be obtained (See Examples).

Hereinafter, a preferable method for obtaining an emulsion of the present invention while introducing dislocation lines into tabular grains (a method based on the aforementioned (2)) is described more specifically.

Tabular grains serving as substrates are prepared by a conventional method. The silver halide content in substrate grains is preferably from 0 to 15 mol %, more preferably from 0 to 12 mol %, and particularly preferably from 0 to 10 mol %.

A silver halide phase containing a large amount of silver iodide (a high content silver iodide phase) is formed in edge portions of the substrate grains. The halogen composition of the silver iodide-containing silver halide phase is not limited. However, higher silver iodide contents are preferable.

In order to obtain remarkable effects of the present invention, use of compounds represented by (I) as a iodide ion source is preferable.

The amount of halogens added for forming a high silver iodide phase (silver iodide-rich phase) on substrate grains is 2–15 mol %, preferably 2–10 mol %, and particularly preferably 2–5 mol %, of the amount of silver contained in the substrate grains.

The high silver iodide phase preferably contains silver in an amount of 5–80 mol %, more preferably 10–70 mol %, and particularly preferably 20–60 mol %, based on the total amount of silver in whole grains.

After forming a high silver iodide phase in edge portions of substrate grains, dislocation lines are introduced by forming a silver halide shell (low silver iodide phase) so that the shell covers the high silver iodide phase.

When the high and low silver iodide phases are formed, pAg is adjusted as described hereinbefore.

The silver halide shell may be composed of silver bromide, silver iodobromide, or silver chloroiodobromide. However, silver bromide or silver iodobromide is preferred.

When silver iodobromide is used, the silver iodide content is preferably from 0.1 to 12 mol %, more preferably from 0.1 to 10 mol %, and particularly preferably from 0.1 to 3 mol %. It is recommended to grow the silver iodide phase in the presence of a polyalkylene oxide block copolymer as it produces remarkable effects of the present invention.

In the above-described dislocation introduction process, the temperature is preferably from 30° to 80° C., more preferably from 35° to 75° C., and particularly preferably from 35° to 60° C.

In an emulsion of the present invention, the coefficient of variation in the silver iodide content in respective grains is preferably from 20 to 3%, more preferably from 15 to 3%, and particularly preferably from 10 to 3%.

The silver iodide content in each grain can be determined by an X ray microanalyzer which can analyze the composition of each grain.

The coefficient of variation in silver iodide content is a value obtained by dividing the variation (standard deviation) in silver iodide content in an individual grain by the mean silver iodide content.

Silver halide emulsions which may be used together in the present invention preferably have in their grains a gradient in halogen composition or a structure which includes portions having different halogen compositions. Typical examples of such emulsion grains are of a core-shell type or double structure type, in which the inner side and the outer side of a grain have different halogen compositions. They are disclosed, for example, in JP-B-43-13,162, JP-A-61-215,540, JP-A-60-222,845, JP-A-60-143,331, and JP-A-61-75,337. Besides the simple double structure, a triple structure disclosed in JP-A-60-222,844 or quadruple or other multiple structures may be employed. Moreover, the surface of a grain with a core-shell double structure may be covered with a thin layer of silver halide having a different halogen composition.

In preparing grains having a intra-grain structure, not only an enveloping structure as mentioned above but also a so-called joint structure may be formed. Examples of the joint structures are disclosed, for example, in JP-A-59-133,540, JP-A-58-108,526, EP-199,290 A2, JP-B-58-24,772, and JP-A-59-16,254. The crystals to be cohered have a composition different from those of host crystals and are grown from the edges, corners, or planes of the host crystals to which they are cohered. Such a joint structure can be formed in either case where host crystals have a uniform structure with respect to the halogen composition or they have a core-shell structure.

As the joint structure, evidently, combined silver halide species can be used. Silver salt compounds such as silver rhodanate and silver carbonate (which do not have rock-salt structures) may be combined with a silver halide to grow a joint structure. Non-silver salt compounds such as lead oxide may be used insofar as they can accommodate a joint structure.

In a preferred embodiment of silver iodobromide grains having the above-mentioned structures, the silver iodide content is greater in the core than in the shell. Conversely, in some cases it is preferred to have grains with a high silver iodide content in the shell and a low silver iodide content in the core. Similarly, with regard to grains having a joint structure, the silver iodide content in host crystals may be high and that in crystals to be jointed may be low, and vice versa. The boundary between two different halogen compositions may or may not be a clear boundary. It is also a preferable embodiment that a continuous change in composition is introduced positively.

In cases where two or more silver halide species are present as a mixed crystal or as a structured body, it is important that the halogen composition distribution is controlled from grain to grain. JP-A-60-254,032 describes a method for determining the distribution of halogen composition among grains. A uniform halogen distribution throughout all grains in an emulsion is a preferable feature. Particularly preferred are highly uniform emulsions having a coefficient of variation of not more than 20%. Other preferable emulsions have a correlation between grain size and halogen composition, for example, such a correlation that larger grains have higher silver iodide contents and smaller grains have lower silver iodide contents. Depending on purposes, reverse correlation or correlation about other halogen composition may also be selected. It is preferred that two or more emulsions having different compositions be used to attain this object.

It is important that the halogen composition near the surfaces of grains is controlled. Increase in the silver iodide or silver chloride content near the surfaces alter the adsorption properties of dyes as well as developing speed of dyes. The increase can be used in accordance with purposes.

For change in the halogen composition near the surface of a grain, a covering-structure of the entire grain may be used. A different halogen composition may be formed only on portions of the grain. For example, any one of (100) and (111) planes of a tetradecahedral grain may have a different halogen composition. Alternatively, one of the primary or side planes of a tabular grain may have a different halogen composition.

The silver halide grains used in the emulsion of the present invention may be selected from both normal crystals which do not include twin planes and crystals which contain twin planes. The latter crystals includes a singlet twin containing one twin plane, a parallel multi-twin containing two or more parallel twin planes, and a non-parallel multi-twins containing two or more non-parallel twin planes, as referred to and described on page 163 of "Fundamentals of Photographic Industry—Silver Salt Photography" edited by the Photographic Society of Japan (publisher: Corona). Examples in which grains with different shapes are blended are disclosed in U.S. Pat. No. 4,865,964, and if desired, the method disclosed therein may be used. As normal crystals, cubic grains composed of (100) planes, octahedral grains composed of (111) planes, and dodecahedral grains composed of (110) planes disclosed in JP-B-55-42,737 and JP-A-60-222,842 may be used. Also, (h11) plane grains typified by (211) grains, (hh1) plane grains typified by (331) grains, (hk0) plane grains typified by (210) grains, and (hk1) plane grains typified by (321) grains, as reported in the Journal of Imaging Science, Vol. 30, page 247 (1986) may also be used depending on purposes though elaborate procedures are needed to prepare them. Moreover, the following may be used depending on purposes: grains in which two planes or multiple planes co-exist, such as tetradecahedral grains in which (100) and (111) planes co-exist in one grain, grains in which (100) and (110) planes co-exist, and grains in which (111) and (110) planes co-exist.

Use of tabular grains In the state of a monodispersion may result in even more preferable results. Structure and methods for preparing monodispersion tabular grains are described in, for example, JP-A-63-151,618. Briefly, in this type of tabular grain, not less than 70% of the total projected area of silver halide grains are occupied by tabular silver halide grains having parallel 2 hexagonal planes as outer surfaces, in which the ratio of the length of the longest side to that of the shortest side is not more than 2. The monodispersion is such one that the coefficient in variation of grain size of the hexagonal tabular silver halide grains (the value obtained by dividing the variation i.e., standard deviation, in grain sizes represented by the circular diameter corresponding to the projected area of the grain by the mean grain size) does not exceed 20%.

As to dislocations, straight or winding dislocations may be introduced along a certain direction of the crystal orientation of grains.

The silver halide emulsion of the present invention may be subjected to a grain-rounding treatment disclosed in EP-96,727-B1 and EP-64,412-B1. Alternatively, it may be subjected to a surface-modifying treatment disclosed in DE-2,306,447-C2 and JP-60-221,320.

Although structures having flat grain surfaces are commonly employed, surfaces with intentionally introduced unevenness are preferred in some cases. For example, there is a method in which holes are bored in portions of crystals such as at an apex and at the center of the plane (JP-A-58-106,532 and JP-A-60-221,320). Another example is ruffle grains as described in U.S. Pat. No. 4,643,966.

The size of emulsion particles which may be used in combination in the present invention can also be evaluated by the use of the sphere-equivalent diameter of a grain volume which is calculated by using the projected area and the thickness of the grain, as well as the sphere-equivalent diameter of the volume determined by a Coulter counter, in addition to the use of the aforementioned circle equivalent diameter of the projected area of a grain determined by an electron microscope. Selection may be made among grains ranging from ultra-fine grains having a sphere-equivalent diameter of not more than 0.05 $\mu$m to coarse grains having a sphere-equivalent diameter greater than 10 $\mu$m. Preferably, grains having a sphere-equivalent diameter between 0.1 $\mu$m and 3 $\mu$m are used as sensitive silver halide grains of the present invention.

As the emulsion of normal crystal grains in the present invention, either a multidispersion system involving a broad grain size distribution or a monodispersion system involving a narrow grain size distribution may be used depending on purposes. As a scale indicating the size distribution, the coefficient in variation of a circular-equivalent diameter of the projected area of a grain or that of a sphere equivalent diameter is sometimes used. When a monodispersion emulsion is employed, the coefficient in variation of the grain sizes of the emulsion is preferably from 25 to 3%, more preferably from 20 to 3%, and particularly preferably from 15 to 3%.

The grain size distribution of the monodispersion emulsion may alternatively be defined such that 80 to 100% by number or by weight of grains fall within +/−30% of the mean grain size. In order to achieve satisfactorily intended gradation of the sensitive material, an emulsion layer having substantially the same color sensitivity may contain two or more monodispersion emulsions of different grain sizes in a mixed state in the same layer or in a multi-layered fashion. Also, two or more multidispersion silver halide emulsions, or monodispersion emulsion and a multidispersion emulsion may be mixed or multi-layered.

In the manufacture of the emulsion of the present invention, processes other than the above-described characteristic techniques of the invention may be performed in accordance with teachings described, for example, in "Chemie et Phisique Photographique" by P. Glafkides, Paul Montel, 1967; "Photographic Emulsion Chemistry", by G. F. Duffin, Focal press, 1966; and "Making and Coating Photographic Emulsion" by V. L. Zelikman et al., Focal Press, 1964. Briefly, an acid method, a neutral method, or an ammonia method may be used. As a format for reacting a soluble silver salt and a soluble halogen salt, mention may be given to a one-sided mixing method, a simultaneous mixing method, and a method combining them. It is also possible to use a method in which grains are grown in the presence of an excessive amount of silver ions (the so-called reverse-mixing method). A so-called controlled double jet method, which is one format of the simultaneous mixing method, may also be used, in which pAg in the liquid phase where silver halide is generated is controlled at a certain level. According to this method, it is possible to obtain a silver halide emulsion which contains grains having a regular crystalline shape and an approximately uniform size.

In some cases, it is a good practice to add silver halide grains formed in a precipitation state in a reaction vessel before starting the preparation of an emulsion. This method is described in U.S. Pat. No. 4,334,012, U.S. Pat. No. 4,301,241, and U.S. Pat. No. 4,150,994. The silver halide grains may be used as seed crystals. Alternatively, they may be advantageously supplied as ones for growing on seed crystals. In the latter case, it is preferred that emulsions of small-sized grains be added. The manner of addition is not particularly limited. The grains may be added all at once, at a plurality of times, or continuously. In this regard, the addition of grains having different halogen compositions may be effective in some cases in order to modify surfaces of the grains.

Methods for converting a major portion or a small portion of the halogen composition of silver halide grains by a halogen conversion method are described, for example, in U.S. Pat. No. 3,477,852, U.S. Pat. No. 4,142,900, EP-273,429, EP-273,430, and DE-A-3,819,241. These are advantageous methods for forming grains. In order to achieve conversion to silver salts which are more difficult to dissolve, a solution containing a soluble halogen or silver halide grains may be added. The conversion may be performed all at one time, at a plurality of times, or continuously.

For growing grains, there is a method in which a soluble silver salt and a halogen salt are added at a fixed concentration and a fixed flow rate. In addition to this, there are known preferable methods for forming grains in which the concentration or flow rate changes, which are described in UK-1,469,480, U.S. Pat. No. 3,650,757, and U.S. Pat. No. 4,242,445. By increasing concentration or flow rate, the amount of the silver halide to be supplied can be changed in a manner defined by a linear function, a quadratic function, or by more complicated functions of time. If desired, the amount of the silver halide to be supplied may be decreased advantageously depending on circumstances. Moreover, it may be preferable to add a plurality of solutions of soluble silver salts having different compositions of solution. In doing so, it is also preferable to increase the amount of one solution, and to decrease that of another solution. A mixer used for reacting a soluble silver salt and a soluble halogen salt may be selected from those described in U.S. Pat. No. 2,996,287, U.S. Pat. No. 3,342,605, U.S. Pat. No. 3,415,650, U.S. Pat. No. 3,785,777, DE-A-2,556,885, and DE-A-2,555,364.

In order to accelerate ripening, use of a silver halide solvent is recommended. For example, it is known that the presence of an excessive amount of halogen ions in a reaction vessel accelerates ripening. Other ripening agents may also be used. The entire amount of the ripening agent may be incorporated into the dispersion medium in a reaction vessel before adding silver and halide salts. Alternatively, ripening agents may be introduced into the reaction vessel when halide salts, silver salts, or deflocculants are added. In another embodiment, a ripening agent may be introduced independently at the stage where halide salts and silver salts are added.

Examples of ripening agents include ammonia, thiocyanates (such as potassium rhodanate and ammonium rhodanate), organic thioether compounds (such as those described in U.S. Pat. No. 3,574,628, U.S. Pat. No. 3,021,215, U.S. Pat. No. 3,057,724, U.S. Pat. No. 3,038,805, U.S. Pat. No. 4,276,374, U.S. Pat. No. 4,297,439, U.S. Pat. No. 3,704,130, U.S. Pat. No. 4,782,013, and JP-A-57-104,926), thione compounds (such as 4-substituted thioureas described in JP-A-53-82,408, JP-A-55-77737, and U.S. Pat. No. 4,221,863 and compounds described in JP-A-53-144,319), mercapto compounds which can accelerate the growth of silver halide grains described in JP-A-57-202,531, and amine compounds (such as those described in JP-A-54-100,717).

As a protective colloid used in the preparation of the emulsion of the present invention, and as a binder for other hydrophilic colloidal layers, gelatin is advantageously used. However, other hydrophilic colloids may also be used.

For example, the following may be used: Proteins such as gelatin derivatives, graft polymers of gelatin and other polymers, albumin, and casein; cellulose derivatives such as hydroxyethylcellulose, carboxymethylcellulose, and sulfuric esters of cellulose; saccharide derivatives such as sodium alginate and starch derivatives; and a diversity of synthetic hydrophilic polymers including homo- and copolymers such as polyvinyl alcohols, polyvinyl alcohols with partial acetals, poly-N-vinylpyrrolidones, polyacrylic acids, polymethacrylic acids, polyacrylic amides, polyvinyl imidazoles, and polyvinyl pyrazoles.

Examples of gelatins which can be used in the present invention include lime-processed gelatins, acid-processed gelatins, and enzyme-processed gelatins described in Bull. Soc. Sci. Photo. Japan. No. 16, page 30 (1966). Also, gelatin hydrolyzates and enzyme-decomposed products may be used as well.

The emulsion of the present invention is preferably washed for the purpose of removing salts and then dispersed in a newly prepared protective colloidal liquid. The temperature of washing water may vary depending on purposes. Preferably, the temperature is selected from the range of 5° C. to 50° C. The pH at the time of washing may be selected depending on purposes. Preferably, pH is selected from the range of 2 to 10. More preferably, it is from 3 to 8. The pAg at the time of washing, which may also be selected depending on purposes, is in the range of 5 to 10. The method of washing may be selected from a noodle washing method, a dialysis method using a semi-permeable membrane, centrifugal separation, a coagulation precipitation method, and an ion exchange method. The coagulation precipitation method includes several methods of using sulfates, organic solvents, water-soluble polymers, or gelatin derivatives.

When the emulsion of the present invention is prepared, for example, in steps of forming grains, removing salts, or chemically sensitizing, or before applying the emulsion, it may be preferable that salts of metal ions be present depending on purposes. In the case of doping into grains, the salts may be added during the formation of grains, whereas in the case of using the salts for modifying grain surfaces or as chemical sensitizers, they are preferably added after grains are formed and before the completion of chemical sensitization. Doping may be performed over the entire grains. Alternatively, doping may be performed only the core, shell or epitaxial portions of grains. Also, only grains present in the substrate portion may be doped. Examples of the metal ion species include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. Any of these metals can be added insofar as they are in the form of salts that may be dissolved during grain formation. Such dissolvable salts include ammonium salts, acetates, nitrates, sulfates, phosphates, hydroxides, 6-coordinated complex salts, and 4-coordinated complex salts. Examples include $CdBr_2$, $CdCl_2$, $Cd(NO_3)_2$, $Pb(NO_3)_2$, $PB(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. Ligands of coordination compounds may be selected from halo, aquo, cyano, cyanate, thiocyanate, nitrosyl, thionitrosyl, oxo, and carbonyl. It is possible to use only one metal compound. Alternatively, two or more species may be used in combination.

It is preferred that metal compounds be added after they are dissolved in a suitable organic solvent such as water, methanol, or acetone. In order to stabilize the solution, an aqueous solution of a hydrogen halide (such as HCl or HBr) or an alkali halide (such as KCl, NaCl, KBr, or NaBr) may be added. If desired, acids and alkalis may also be added. Metal compounds may be added to a reaction vessel in which grains have not yet been formed or during grain formation. Alternatively, metal compounds may be added to an aqueous solution of a water-soluble silver salt (such as $AgNO_3$) or an alkali halide (such as NaCl, KBr, or KI), and the resulting solution may be added continuously during formation of silver halide grains. Alternatively, a solution separate from the water-soluble silver salt and alkali halide may be prepared, and may be added in a continuous manner at a suitable time during grain formation. Combinations of a variety of methods may also be used.

In some cases, it is advantageous that chalcogen compounds as described in U.S. Pat. No. 3,772,031 be added during preparation of an emulsion. In addition to S, Se, and Te, species may be present which include cyanates, thiocyanates, selenocyanates, carbonates, phosphates, and acetates.

The silver halide grains of the present invention may be subjected to at least one of sulfur sensitization, selenium sensitization, gold sensitization, palladium sensitization or noble metal sensitization, or reduction sensitization in any steps during manufacture of a silver halide emulsion. Combinations of two or more sensitization methods are preferable. Depending on the steps in which chemical sensitization is performed, different types of emulsions can be prepared. Selection may be made from emulsions of a type in which chemical sensitization nuclei are deeply embedded inside grains, a type in which chemical sensitization nuclei are embedded inside grains but close to the surfaces, and of a type in which chemical sensitization nuclei are attached to grain surfaces. Although the grains of the emulsion of the present invention may contain chemical sensitization nuclei at any portion of individual grains depending on purposes, grains which have at least one type of chemical sensitization nuclei in regions close to grain surfaces are generally preferred.

In one of chemical sensitization processes which may be preferably performed in the present invention, chalcogen sensitization and noble metal sensitization are used solely or in combination. Active gelatins may be used as described in T. H. James, "The Theory of the Photographic Process", 4th ed., Macmillan, 1977, pp. 67–76. Alternatively, sulfur, selenium, tellurium, gold, platinum, palladium, iridium, or any combinations of them may be used under conditions where pAg is 5 to 10, pH is 5 to 8, and the temperature is 30 to 80° C. as described in Research Disclosure, Vol. 120, April, 1974, 12008, Research Disclosure, Vol. 34, June, 1975, 13452, U.S. Pat. No. 2,642,361, U.S. Pat. No. 3,297,446, U.S. Pat. No. 3,772,031, U.S. Pat. No. 3,857,711, U.S. Pat. No. 3,901,714, U.S. Pat. No. 4,266,018, U.S. Pat. No. 3,904,415, and UK-1,315,755. If noble metal sensitization is pursued, noble metals such as gold, platinum, palladium or iridium may be used. Particularly, gold sensitization, palladium sensitization, and a combination of them are preferred. Gold sensitization may be performed using known compounds such as gold chloride acid, potassium chloroaurate, potassium aurithiocyanate, gold sulfide, and gold selenide. By palladium compounds is meant divalent or tetravalent salts of palladium. Preferable palladium compounds are represented by $R_2PdX_6$ or $R_2PDX_4$. Here, R represents a hydrogen atom, an alkali metal atom, or an ammonium group. X represents a halogen atom such as chlorine, bromine, or iodine.

More specifically, preferable palladium compounds include $K_2PdCl_4$, $(NH_4)_2PdCl_6$, $(Na_2)_2PdCl_4$, $(NH_4)_2PdCl_4$, $Li_2PdCl_4$, $Na_2PdCl6$, and $K_2PdBr_4$. The gold compounds and palladium compounds are preferably used in combination with thiocyanates or selenocyanates.

As sulfur sensitizers, it is possible to use hypos, thiourea compounds, rhodanine compounds, and sulfur-containing compounds described in U.S. Pat. No. 3,857,711, U.S. Pat. No. 4,266,018, and U.S. Pat. No. 4,054,457. Chemical sensitization may be performed in the presence of so-called chemical sensitization auxiliaries such as azaindenes, azapyridazines, and azapyrimidines which are known to suppress fogging and increase sensitivity during chemical sensitization. Examples of chemical sensitization auxiliary modifiers are described in U.S. Pat. No. 2,131,038, U.S. Pat. No. 3,411,914, U.S. Pat. No. 3,554,757, JP-A-58-126,526, and the afore-mentioned "Photographic Emulsion Chemistry" by G. F. Duffin, p.p. 138-143.

The emulsion of the present invention preferably undergoes gold sensitization. Gold sensitization agents are preferably incorporated in amounts from $1\times10^{-4}$ to $1\times10^{-7}$, and more preferably, from $1\times10^{-5}$ to $5\times10^{-7}$ mols per mol of silver halide. Palladium compounds are preferably used in amounts from $1\times10^{-3}$ to $5\times10^{-7}$. Thiocyanates and selenocyanates are preferably used in amounts from $5\times10^{-2}$ to $1\times10^{-6}$.

Sulfur sensitization agents are preferably incorporated into the silver halide grains of the present invention in amounts from $1\times10^{-4}$ to $1\times10^{-7}$, and more preferably, from $1\times10^{-5}$ to $5\times10^{-7}$ mols per mol of silver halide.

In the present invention, the silver halide emulsion preferably undergoes selenium sensitization. In performing selenium sensitization, known unstable selenium compounds are used. Specifically, selenium compounds may be used which include colloidal metal selenium, selenoureas (such as N,N-dimethylseleno urea and N,N-diethylselenourea), selenoketones, and selenoamides. In some cases, it is preferred that selenium sensitization be combined with sulfur sensitization or noble metal sensitization, or with both.

It is advantageous that the silver halide emulsion of the present invention is subjected to reduction sensitization during formation of grains, during the period after formation of grains but before or during chemical sensitization, or after chemical sensitization.

In performing reduction sensitization, any one of the following methods may be used: A method in which a reduction sensitization agent is added to a silver halide emulsion; a so-called silver ripening in which grains in the emulsion are grown or ripened in a low pAg atmosphere (pAg: 1–7); or a so-called high pH ripening in which grains are grown or ripened in a high pH atmosphere (pH: 8–11). It is also possible to combine two or more of these methods.

A method in which reduction sensitization is added is preferred in view that the level of reduction sensitization can be subtly controlled.

Examples of known reduction sensitizers include stannous salts, ascorbic acid and derivatives thereof, amines and polyamines, hydrazine derivatives, formamidine sulfinates, silane compounds, and borane compounds. A suitable reduction sensitizer is selected from them when reduction sensitization is performed in the present invention. Alternatively, two or more compounds may be used in combination. Examples of preferable reduction sensitizers include stannaous chloride, thiourea dioxide, dimethylamine borane, and ascorbic acid and derivatives thereof. Amounts of reduction sensitizers to be added depend on the conditions under which emulsions are prepared. Therefore, they must be determined carefully. It is normally suitable to use a reduction sensitizer in an amount of $10^{-7}$–$10^{-3}$ mol per mol of silver halide.

Reduction sensitizers are dissolved in organic solvents such as water, alcohols, glycols, ketones, esters, or amides, and then added to a reaction vessel while grains are growing. Although they may be placed in the reaction vessel in advance, it is preferred that they be added at a suitable time during the growth of grains. Alternatively, they may be added to an aqueous solution of a water-soluble silver salt or a water-soluble alkali halide in advance, and using the resulting solution, silver halide grains may be precipitated. It is also a good practice that portions of a solution of a reduction sensitizer are added at a plurality of times as grains grow or continuously added over a prolonged period.

During manufacture of an emulsion of the present invention, an oxidizer acting on silver is preferably used. By the oxidizer acting on silver is meant a compound which acts on metallic silver to convert it into silver ions. Particularly useful compounds for this purpose are those capable of converting very fine grains which are by-produced during formation of silver halide grains and chemical sensitization into silver ions. The resulting silver ions may form silver salts which are difficult to dissolve in water, such as silver halides, silver sulfide, and silver selenide. Alternatively, they may form silver salts which are easily soluble in water, such as silver nitrate. The oxidizer acting on silver may be either inorganic or organic. Examples of the inorganic oxidizers include ozone, hydrogen peroxide and its adducts (such as $NaBO_2.H_2O_2.3H_2O$, $2NaCO_3.3H_2O_2$, $Na_4P_2O_7.2H_2O_2$, and $2Na_2SO_4.H_2O_2.H_2O$), peroxy acid salts (such as $K_2S_2O_8$, $K_2C_2O_6$, and $K_2P_2O_8$), peroxy complexes (such as $K_2[Ti(O_2)C_2O_4].3H_2O$, $4K_2SO_4.Ti(O_2)OH.SO_4.2H_2O$, and $Na_3[VO(O_2)(C_2H_4)_2].6H_2O$), salts of oxyacid such as permanganates (such as $KMnO_4$) and chromates (such as $K_2Cr_2O_7$), halogen elements such as iodine and bromine, salts of perhagogenoacids (such as potassium periodate), salts of metals with high valences (such as potassium hexacyanoferrate), and thiosulfonate.

Examples of the organic oxidizers include quinones such as p-quinone, organic peroxides such as peracetic acid and perbenzoic acid, and compounds which release active halogens (such as N-bromosuccinimide, chloramine T, and chloramine B).

Oxidizers which are preferably used in the present invention include inorganic oxidizers such as ozone, hydrogen peroxide and its adducts, halogen elements, and thiosulfonates, and organic oxidizers such as quinones. It is a preferable embodiment that the aforementioned reduction sensitization is performed in the presence of an oxidizer acting on silver. A suitable method may be selected from the methods of performing reduction sensitization after using an oxidizer, or vice versa, and the method of performing them concurrently. These methods may be performed during grain forming or during chemical sensitization.

The emulsion of the present invention may contain various of compounds in order to prevent fogging occurable during the manufacture of sensitizing materials, during storage, or during processing of photographs, or to stabilize photographic properties. Such compounds include a diversity of compounds known as antifogging agents or stabilizers including thiazoles such as benzothiazolium salts, nitroimidazoles, nitrobenzimidazoles, chlorobenzimidazoles, bromobenzimidazoles, mercaptothidiaazoles, mercaptobenzothiazoles, mercaptobenzimidazoles, mercaptothiazoles, aminotriazoles, benzotriazoles, nitrobenzotriazoles, and mercaptotetrazoles (particularly, 1-phenyl-5-mercaptotetrazole); mercaptopyrimidines; mercaptotriazines; thioketo compounds, for example, oxadrinthione; azaindenes such as triazaindenes and tetrazaindenes (particularly, 4-hydroxy-substituted (1,3,3a,7) tetrazaindenes) , and pentazaindenes. For example, those described in U.S. Pat. No. 3,954,474, U.S. Pat. No. 3,982, 947, and JP-B-52-28,660 may be used. As a preferred compound, there is a compound described in JP-A-63-212, 932. Antifogging agents and stabilizers may be added in a variety of stages such as before grains are formed, during grains are formed, after grains are formed, during washing with water, during the stage of dispersing which follows washing, before performing chemical sensitization, during chemical sensitization, after chemical sensitization, and before applying the emulsion, depending on purposes. They may be used not only for attaining their original purposes of antifogging and stabilizing effects by adding them during the preparation of an emulsion, but also multiple purposes which include controlling crystal habit of grains, reducing the grain size, reducing solubility of grains, controlling chemical sensitization, and controlling the disposition of dyes.

The emulsion of the present invention is preferably spectrally sensitized by methine dyes, etc. in order to promote the effects of the invention. Dyes which may be used include cyanine dyes, merocyanine dyes, complex cyanine dyes, complex merocyanine dyes, holopollar cyanine dyes, hemicyanine dyes, styryl dyes, and hemioxole dyes. Particularly useful dyes are those in the categories of cyanine dyes, merocyanine dyes, and complex merocyanine dyes. To these dyes, may be applied any nuclei which are ordinarily applied to cyanine dyes as basic heterocyclic nuclei. Examples of such nuclei include pyrroline, oxazoline, thiozoline, pyrrole, oxazole, thiazole, selenazole, imidazole, tetrazole, pyridine; nuclei resulting from condensing an alicyclic hydrocarbon ring to any one of these nuclei; nuclei resulting from condensing an aromatic hydrocarbon ring to any one of these nuclei, such as indolenine, benzoindolenine, indole, benzoxadole, naphthoxazole, benzothiazole, naphthothiazole, benzoselenazole, benzimidazole, and quinoline. These nuclei may have substituents on carbon atoms.

To merocyanine dyes or complex merocyanine dyes, 5- to 6-membered heterocyclic rings may be applied as nuclei having a ketomethylene structure. Specific examples of such nuclei include pyrazolin-5-one, thiohidantoin, 2-thiooxazolidine-2,4-dione, thiazolidine-2,4-dione, rhodanine, and thiobarbituric acid.

These sensitizing dyes may be used singly or in combination. Sensitizing dyes are frequently used in combination in order to obtain a supersensitization. Typical examples are found in U.S. Pat. No. 2,688,545, U.S. Pat. No. 2,977,229, U.S. Pat. No. 3,397,060, U.S. Pat. No. 3,522,052, U.S. Pat. No. 3,527,641, U.S. Pat. No. 3,617,293, U.S. Pat. No. 3,628,964, U.S. Pat. No. 3,666,480, U.S. Pat. No. 3,672,898, U.S. Pat. No. 3,679,428, U.S. Pat. No. 3,703,377, U.S. Pat. No. 3,769,301, U.S. Pat. No. 3,814,609, U.S. Pat. No. 3,837,862, U.S. Pat. No. 4,026,707, UK-1,344,281, UK-1, 507,803, JP-B-43-4936, JP-B-53-12,375, JP-A-52-110,618, and JP-A-52-109,925.

In addition to the above-mentioned sensitizing dyes, the emulsion may contain a dye which itself does not have a spectral sensitizing effect, or a material which absorb substantially no visible light and exhibits a super-sensitizing effect.

The sensitizing dyes may be added to the emulsion in any stage of the processes of preparing the emulsion, which stage is known as being proper for addition of sensitizing dyes. It is most common to add sensitizing dyes to the emulsion during the period after completion of chemical sensitization and before application to film. However, sensitizing dyes may be added to the emulsion along with a chemical sensitizing agent so as to simultaneously perform spectral sensitization and chemical sensitization, as described in U.S. Pat. Nos. 3,628,969 and 4,225,666, or added prior to chemical sensitization, as described JP-A-58-11928. Also, sensitizing dyes may be added to the emulsion before precipitation of silver halide grains is completed. Moreover, as described in U.S. Pat. No. 4,225,666, the above-mentioned compounds may be separately added to the emulsion. That is, a portion of the above-mentioned compounds may be added to the emulsion prior to chemical sensitization and the remaining portion may be added to the emulsion after chemical sensitization. Addition of a sensitizing dye may be performed at any timing during the process of forming silver halide grains, as in the method described in U.S. Pat. No. 4,183,756.

The sensitizing dye may be added in an amount of $4\times10^{-6}$–$8\times10^{-3}$ mol per mol of silver halide. However, for silver halide grains having a more preferable size of 0.2–1.2 $\mu$m, an amount of about $5\times10^{-5}$–$2\times10^{-3}$ mol is effective.

The sensitive material manufactured using the silver halide emulsion of the present invention has at least one layer of blue-sensitive, green-sensitive and red-sensitive silver halide emulsion layers. No limitation is imposed on the total number of and the lamination order of the silver halide emulsion layers. A typical example is a silver halide photographic sensitive material which comprises a support and, provided thereon, at least one unit sensitive layer composed of a plurality of silver halide emulsion layers which have substantially identical color sensitivities but have different levels of sensitivity. The unit sensitive layer is sensitive to one of blue light, green light or red light. Moreover, in multilayer silver halide color photographic sensitive materials, the unit sensitive layers are generally superposed on a support in the order of, as viewed from the support, a unitred-sensitive layer, a unit green-sensitive layer and a unit blue-sensitive layer. However, in accordance with a desired object, the lamination order may be reversed and a sensitive layer having different color sensitivity may be sandwiched between any two adjacent sensitive layers having the identical color sensitivity.

Various intermediate nonsensitive layers may be provided between any two adjacent silver halide sensitive layers, and may be the uppermost layer or the lowermost layer.

The intermediate nonsensitive layers may contain couplers and DIR compounds described in JP-A-61-43748, JP-A-59-113438, JP-A-59-113440, JP-A-61-20037 and JP-A-61-20038.

Plural silver halide emulsion layers which constitute each unit sensitive layer preferably have a two-layer structure of a high sensitivity emulsion layer and a lower sensitivity emulsion layer as described in West German Patent No. 1,121,470 or British Patent No. 923,045. In general, it is preferable that the emulsion layers are disposed in an order such that the sensitivities thereof decrease toward the support. Further, nonsensitive layers may be provided between any two adjacent silver halide emulsion layers. Furthermore, low and high sensitivity emulsion layer may be disposed at the sides remote to and closed to the support,respectively, as described in JP-A-57-112751, JP-A-62-200350, JP-A-62-206541, JP-A-62-206543 and the like.

Specific examples of the order of lamination include, from the remote side of the support toward the support, a blue-sensitive layer of low sensitivity (BL), a blue-sensitive layer of high sensitivity (BH), a green-sensitive layer of high sensitivity (GH), a green-sensitive layer of low sensitivity (GL), a red-sensitive layer of high sensitivity (RH) and a red-sensitive layer of low sensitivity (RL); BH/BL/GL/GH/RH/RL; and BH/BL/GH/GL/RL/RH.

It is possible to dispose blue-sensitive layers/GH/RH/GL/RL in this order from the remote side of the support as described in JP-B-55-34932. Alternatively, it is also possible to dispose blue-sensitive layers/GL/RL/GH/RH in this order from the remote side of the support as described in JP-A-56-25738 and JP-A-62-63936.

JP-B-49-15495 discloses a three layer arrangement in which three layers having different sensitivities are disposed in an order toward the support such that the uppermost layer is a silver halide emulsion layer having the highest sensitivity, the intermediate layer is a silver halide emulsion layer of intermediate sensitivity, and the lowermost layer is a silver halide emulsion layer of the lowest sensitivity, i.e. such that sensitivity becomes weak toward the support. In such a three-layer structure in which each layer has a different sensitivity, layers having the same color sensitivity may be arranged such that an emulsion layer of intermediate sensitivity/an emulsion layer of high sensitivity/an emulsion layer of low sensitivity are layered in order from the side remote to the support as described in JP-A-59-202464.

Alternatively, orders of layering such as emulsion layer of high sensitivity/emulsion layer of low sensitivity/emulsion layer of intermediate sensitivity, and emulsion layer of low sensitivity/emulsion layer of intermediate sensitivity/emulsion layer of high sensitivity may also be applicable.

In cases of four or more layers, the lamination order can be varied as described above.

As described above, various layer structures and arrangements may be adopted according to the intended functions of the sensitive materials.

Although the above-described various additives are used for the sensitive materials of the present invention, other additives may be adopted according to intended functions of the sensitive materials.

These additives are described in detail in Research Disclosure Item 17643 (December, 1987), ibid., Item 18716 (November, 1979), and ibid., Item 308119 (December, 1989). The relevant portions of these publications are listed in the following table.

| Additive | RD No. 17643 | RD No. 18716 | RD No. 308119 |
|---|---|---|---|
| 1. Chemical sensitizers | p 23 | p 648 right column | p 996 |
| 2. Sensitivity increasing agents | | p 648 right column | |
| 3. Spectral sensitizers, Supersensitizers | p 23–p 24 | p 648 right column–p 649 right column | p 996 right column–p 998 right column |
| 4. Brightening agents | p 24 | p 647 right column | p 998 right column |
| 5. Antifogging agents, Stabilizers | p 24–p 25 | p 649 right column | p 998 right column–p 1000 right column |
| 6. Light absorbers, Filter dyes, UV absorbers | p 25–p 26 | p 649 right column–p 650 left column | p 1003 left column–p 1003 right column |
| 7. Stain inhibitors | p 25 right column | p 650 left column–right column | p 1002 right column |
| 8. Color image stabilizers | p 25 | | p 1002 right column |
| 9. Hardeners | p 26 | p 651 left column | p 1004 right column–p 1005 left column |
| 10. Binders | p 26 | p 651 left column | p 1003 right column–p 1004 right column |
| 11. Plasticizers, Lubricants | p 27 | p 650 right column | p 1006 left column–p 1006 right column |
| 12. Coating aids, Surfactants | p 26–27 | p 650 right column | p 1005 left column–p 1006 left column |
| 13. Antistatic agents | p 27 | p 650 right column | p 1006 right column–p 1007 left column |
| 14. Matte agents | | | p 1008 left column–p 1009 left column |

Moreover, in order to prevent deterioration of photographic performance caused by the presence of formaldehyde gas, it is advisable to add, into sensitive materials, compounds capable of fixing formaldehyde by reaction therewith which are described in U.S. Pat. No. 4,411,987 and U.S. Pat. No. 4,435,503.

Various color couplers can be used for sensitive material manufactured by using the emulsion of the present invention, specific examples of which are described in the patents cited in aforementioned RD, No. 17643, VII, C-G and ibid., No. 307135, VII, C-G.

As for yellow couplers, preferable examples include those described in U.S. Pat. No. 3,933,501, U.S. Pat. No. 4,022,620, U.S. Pat. No. 4,326,024, U.S. Pat. No. 4,401,752, U.S. Pat. No. 4,248,961, JP-B-58-10739, British Patent Nos. 1,425,020 and 1,476,760, U.S. Pat. No. 3,973,968, U.S. Pat. No. 4,314,023, U.S. Pat. No. 4,511,649 and EP-249,473A.

As for magenta couplers, 5-pyrazolone compounds and pyrazoloazole compounds are preferable. Especially, compounds described in U.S. Pat. No. 4,310,619, U.S. Pat. No. 4,351,897, European Patent No. 73,636, U.S. Pat. No. 3,061,432, U.S. Pat. No. 3,725,067, Research Disclosure No. 24220 (June, 1984), JP-A-60-33552, Research Disclosure No. 24230 (June, 1984), JP-A-60-43659, JP-A-61-72238, JP-A-60-35730, JP-A-55-118034 and JP-A-60-185951, U.S. Pat. No. 4,500,630, U.S. Pat. No. 4,540,654, U.S. Pat. No. 4,556,630 and PCT International Publication No. WO88/04795 are preferred.

As for cyan couplers, mention may be given to phenol type and naphthol type couplers. Preferable examples of cyan couplers are those described in U.S. Pat. No. 4,052, 212, U.S. Pat. No. 4,146,396, U.S. Pat. No. 4,228,233, U.S. Pat. No. 4,296,200, U.S. Pat. No. 2,369,929, U.S. Pat. No. 2,801,171, U.S. Pat. No. 2,772,162, U.S. Pat. No. 2,895,826, U.S. Pat. No. 3,772,002, U.S. Pat. No. 3,758,308, U.S. Pat. No. 4,334,011, U.S. Pat. No. 4,327,173, West German Patent No. 3,329,729, European Patent Application Nos. 121,365A and 249,453A, U.S. Pat. No. 3,446,622, U.S. Pat. No. 4,333,999, U.S. Pat. No. 4,775,616, U.S. Pat. No. 4,451,559, U.S. Pat. No. 4,427,767, U.S. Pat. No. 4,690,889, U.S. Pat. No. 4,254,212, U.S. Pat. No. 4,296,199, and JP-A-61-42658.

Typical examples of polymerized color forming couplers are described, for example, in U.S. Pat. No. 3,451,820, 4,080,211, U.S. Pat. No. 4,367,282, U.S. Pat. No. 4,409,320, U.S. Pat. No. 4,576,910, British Patent No. 2,102,137 and European Patent Application No. 341,188A.

As for couplers with which color generating dyes have an adequate diffusion property, preferable ones are those described in U.S. Pat. No. 4,366,237, British Patent No. 2,125,570, European Patent No. 96,570 and West German Patent (OLS) No. 3,234,533.

Preferable examples of colored couplers for compensating for unnecessary absorptions of color generating dyes include those described in RD, No. 17643, VII-G, ibid. No. 307105, VII-G, U.S. Pat. No. 4,163,670, JP-B-57-39413, U.S. Pat. No. 4,004,929, U.S. Pat. No. 4,138,258, and British Patent No. 1,146,368. It is also preferable to use couplers described in U.S. Pat. No. 4,774,181, which compensate for unnecessary absorptions of color generating dyes by fluorescent dyes released at the time of coupling, and couplers described in U.S. Pat. No. 4,777,120, which have, as a releasable group, a dye precursor group capable of forming dyes by the reaction with a developing agent.

Compounds which release photographically useful residues in a coupling reaction are also useful in the present invention. Preferable examples of DIR couplers which release development inhibitors are disclosed in the patents cited in the aforementioned RD, No. 17643, VII-F, ibid. No. 307105, VII-F, JP-A-57-151944, JP-A-57-154234, JP-A-60-184248, JP-A-63-37346 and JP-A-63-37350, U.S. Pat. No. 4,248,962 and U.S. Pat. No. 4,782,012.

Preferable couplers which release nucleating agents or development accelerators in the configuration of the images in the developing process include those described in British Patent Nos. 2,097,140 and 2,131,188, and JP-A-59-157638 and JP-A-59-170840. Other preferable compounds include those which release fogging agents, development accelerators, solvents for silver halides, by the oxidation-reduction reaction with an oxidation product of a developing agent, which are described in JP-A-60-107029, JP-A-60-252340, JP-A-1-44940 and JP-A-1-45687.

Other compounds which can be used in the sensitive materials of the present invention include competitive couplers described, for example, in U.S. Pat. No. 4,130,427, multi-equivalent couplers described, for example, in U.S. Pat. No. 4,283,472, U.S. Pat. No. 4,338,393 and U.S. Pat. No. 4,310,618, DIR redox compound releasing couplers, DIR coupler releasing couplers, DIR coupler releasing redox compounds and DIR redox releasing redox compounds described, for example, in JP-A-60-185950 and JP-A-62-24252, couplers which release dyes which recover initial colors after being released described, for example, in EP-173,302A and 313,308A, bleaching accelerators described, for example, in RD, No. 11449, ibid. No. 24241, and JP-A-61-201247, ligand releasing couplers described, for example, in U.S. Pat. No. 4,555,477, couplers which release leuco dyes described in JP-A-63-75747, and couplers which release fluorescent dyes described in U.S. Pat. No. 4,774,181.

The couplers which are used in the present invention can be introduced into sensitive materials by various known dispersion methods.

Examples of high boiling point solvents which are useful in the oil-in-water dispersion method are described, for example, in U.S. Pat. No. 2,322,027.

Examples of high boiling point organic solvents having a boiling point of 175° C. or higher at atmospheric pressure and applicable to the oil-in-water dispersion method include phthalic esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl) isophthalate, bis(1,1-diethylpropyl)phthalate); esters of phosphoric acid or phosphonic acid (for example, triphenyl phosphate, tricresyl phosphate, 2-ethylhexyl diphenylphosphate, tricyclohexyl phosphate, tri-2-ethylhexyl phosphate, tridodecyl phosphate, tributoxyethyl phosphate, trichloropropyl phosphate, di-2-ethylhexyl phenylphosphate); benzoic esters (for example, 2-ethylhexyl benzoate, dodecylbenzoate, 2-ethylhexyl-p-hydroxybenzoate); amides (for example, N,N-diethyldodecaneamide, N,N-diethyllaurylamide and N-tetradecylpyrolidone); alcohols and phenols (for example, isostearyl alcohol and 2,4-di-tert-amylphenol); aliphatic carboxylic esters (for example, bis (2-ethylhexyl)sebacate, dioctylazelate, glycerol tributylate, isostearyl lactate and trioctylcitrate); aniline derivatives (for example, N,N-dibutyl-2-butoxy-5-tert-octylaniline); and hydrocarbons (for example, paraffin, dodecyl benzene and diisopropylnaphthalene). Auxiliary solvents may also be used which include organic solvents having a boiling point of about 30° C. or higher, and preferably between 50° and about 160° C. Examples of such solvents include ethyl acetate, butyl acetate, ethyl propionate, methylethylketone, cyclohexanone, 2-ethoxyethyl acetate and dimethylformamide.

Specific examples of the steps of latex dispersion method, effects thereof, and latexes to be used for impregnation are described, for example, in U.S. Pat. No. 4,199,363, West German Patent (OLS) Nos. 2,541,274 and 2,541,230.

It is preferable that the color photographic sensitive materials of the present invention contain various preservatives or antifungal agents such as 1,2-benzisothiazolin-3-one, n-butyl-p-hydroxybenzoate, phenol, 4-chloro-3,5-dimethylphenol, 2-phenoxyethanol and 2-(4-thiazolyl) benzimidazole as described in JP-A-63-257747, JP-A-62-272248 and JP-A-1-80941 and phenethyl alcohol.

The present invention can be applicable to a variety of color photographic sensitive materials, typified by color negative films for general use or movies, color reversal films for slides or television, color papers, color positive films and color reversal papers. Particularly, the present invention is preferably used for color duplicating films.

Supports which are suited for use in the present invention are described, for example, in the aforementioned RD, No. 17643, page 28, ibid., No. 18716 page 647, right column to page 648, left column and ibid., No. 307105, page 879.

It is preferable that the total thickness of all of the hydrophilic colloid layers on the side having emulsion layers is not more than 28 μm, more preferably not more than 23 μm, still more preferably not more than 18 μm, and most preferably not more than 16 μm. Moreover, the layer swelling speed $T_{1/2}$ is preferably not more than 30 seconds, and more preferably not more than 20 seconds. "Layer thickness" as used herein is that measured at 25° C. under a relative humidity of 55% RH (2 days). The layer swelling speed $T_{1/2}$ can be measured by methods known in the art. For instance, a swellometer of a type described in "Photographic Science and Engineering", Vol. 19, No. 2, 124–129 as proposed by A. Green et al. can be employed. $T_{1/2}$ is defined to be the period of time required for the thickness of the layer to reach half of the saturated layer thickness under the conditions that 90% of the maximum thickness of the swollen layer obtained by treating the layer in a color developer of 30° C. for 3 minutes and 15 seconds is considered to be the saturated layer thickness.

The layer swelling speed $T_{1/2}$ is controlled by adding a hardening agent to gelatin which serves as a binder, or by changing conditions relating to time after coating.

It is preferable that the sensitive materials according to the present invention have hydrophilic colloidal layers (hereinafter referred to as backing layers) such that the total thickness of all the hydrophilic layers in a dry state falls in the range of 2 to 20 μm. on a side of support opposite to the side at which the emulsion layers are provided. The backing layers preferably contain aforementioned optical absorbers, filter dyes, UV absorbers, anti-static agents, hardening agents, binders, plasticizers, lubricants, coating aids, surfactants, and the like. The swelling rate of a backing layer is preferably 150 to 500%.

According to the present invention, color photographic sensitive materials can be developed by conventional methods described in the aforementioned RD, No. 17643, pages 28–29, ibid., No. 18716, page 651, left through right columns and ibid., No. 307105, pages 880 to 881.

Color developers which are useful for developing the sensitive materials according to the present invention are preferably aqueous alkaline solutions containing, as main ingredients, aromatic primary amine type color developing agents. Aminophenol type compounds may be mentioned as a useful color developing agent. Preferably, however, p-phenylenediamine type compounds are used, typical examples of which include 3-methyl-4-amino-N,N-diethylaniline, 3-methyl-4-amino-N-ethyl-N-β-hydroxyethylaniline, 3-methyl-4-amino-N-ethyl-N-β-methanesulfonamide ethyl aniline, 3-methyl-4-amino-N-ethyl-β-methoxyethylaniline, and their sulfates, hydrochlorides and p-toluenesulfonates. Of these compounds, particularly preferred are sulfuric acid salts of 3-methyl-4-amino-N-ethyl-N-β-hydroxyethylaniline. These compounds may be used in a combination of two or more according to purposes.

Color developers generally contain pH buffers such as carbonates, borates and phosphates of alkali metals, as well as development inhibitors or antifogging agents such as chlorides, bromides, iodides, benzimidazoles, benzthiazoles and mercapto compounds. As needed, the following agents may also be incorporated: hydrazines such as hydroxylamine, diethylhydroxylamine, sulfites and N,N-biscarboxymethylhydrazine; various preservatives such as phenylsemicarbazides, triethanolamine and catecholsulfonic acid; organic solvents such as ethylene glycol and diethylene glycol; development accelerators such as benzyl alcohol, polyethylene glycol, quaternary ammonium salts and amines; color forming couplers; competitive couplers; auxiliary developing agents such as 1-phenyl-3-pyrazolidone; viscosity imparting agents; various chelating agents typified by aminopolycarboxylic acid, aminopolyphosphonic acid, alkylphosphonic acid and phosphonocarboxylic acid. Typical examples of such chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylene phosphonic acid, ethylenediamine-N,N-N',N'-tetramethylenephosphonic acid, ethylenediamine-di(o-hydroxyphenylacetic acid) and salts thereof.

In general, when reversal processing is performed, a color development step follows a black-and-white development step. In black-and-white developing solutions, known black-and-white developing agents are used, for example, dihydrobenzenes such as hydroquinone, 3-pyrazolidones such as 1-phenyl-3-pyrazolidone and aminophenols such as N-methyl-p-aminophenol, alone or in combination. The pH of the color developing solutions and black-and-white developing solutions is generally 9 to 12. The replenishing amount of these developing solutions depends on the type of color photographic sensitive material to be processed. In general, the amount does not exceed 3 liters per square meter of the sensitive material. It can be made to 500 ml/$m^2$ or less by reducing the concentration of bromide ions in the replenisher. In case in which the replenishing amount is reduced, it is preferable to reduce the area of the solution in the processing tank that contacts the air so as to prevent the solution from being evaporated or oxidized.

The contact area of the photographic processing solution and the air in the processing tank is expressed by the opening ratio as defined below:

Opening Ratio=[contact area ($cm^2$) between processing solution and air]/[volume ($cm^3$) of processing solution]

The opening ratio is preferably not greater than 0.1, and is more preferably 0.001 to 0.05. In order to reduce the opening ratio, covers such as a floating lid may be placed on the surface of the photographic processing solution in the processing tank. Alternatively, a movable lid described in JP-A-1-82033 may be used, or a slit developing method described in JP-A-63-216050 may be used. Reduction of the opening ratio is advisable not only in the color development and the black-and-white development steps, but also in all of the subsequent steps including bleaching, bleaching-fixing, fixing, washing and stabilizing. The replenishing amount can also be reduced by adopting means for restraining accumulation of bromide ions in the developer.

Time required for the color developing process is normally set from 2 to 5 minutes. This time can be shortened by making temperature and pH high and by using a high concentration of the color developing agent.

After color development, the photographic emulsion layers are usually subjected to bleach processing. Bleaching processing may be performed simultaneously with fixing processing (bleaching-fixing processing) or may be performed independently from fixing processing. Further, for the purpose of rapid processing, a processing method wherein a bleaching-fixing processing is carried out after bleaching processing may be employed. Moreover, it may be appropriate depending on purposes to use a continuous two tank bleaching-fixing bath, to perform fixing processing before bleaching-fixing processing, or to perform bleaching processing after bleaching-fixing processing. Examples of bleaching agents include compounds of a multivalent metal such as iron (III), peracids (especially, sodium persulfate is suitable for color negative films for movies), quinones and nitro compounds. Typical examples of the bleaching agents include organic complex salts of iron (III), for example, complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, and complex salts of citric acid, tartaric acid and malic acid and the like. Of these compounds, iron (III) complex salts of aminopolycarboxylic acids such as iron (III) complex salt of ethylenediaminetetraacetic acid and iron (III) complex salt of 1,3-diaminopropanetetraacetic acid are preferred in view of rapid processing and less environmental pollution. Furthermore, iron (III) complex salts of aminopolycarboxylic acids are particularly useful in both bleaching solutions and bleaching-fixing solutions. The pH of the bleaching solution or bleaching-fixing solution containing these iron (Ill) complex salts of an aminopolycarboxylic acid is usually in a range from 4.0 to 8. For the purpose of rapid processing, it is possible to process at a pH lower than this range.

The bleaching solution, the bleaching-fixing solution and a prebath thereof may contain a bleaching accelerator, if desired. As for specific examples of useful bleaching accelerator, the following patent specifications are referred to. U.S. Pat. No. 3,893,858, West German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-18426. RD, No. 17129 (July, 1978) disclose compounds having a mercapto group or a disulfide group; JP-A-51-140129 discloses thiazolidine derivatives; JP-B-45-8506, JP-A-52-20832 and JP-A-53-32735 and U.S. Pat. No. 3,706,561 disclose thiourea derivatives; West German Patent No. 1,127,715 and JP-A-58-16235 disclose iodides; West German Patents Nos. 966,410 and 2,748,430 disclose polyoxyethylene compounds; JP-B-45-8836 discloses polyamine compounds; JP-A-49-40943, JP-A-49-59644, JP-A-53-94927, JP-A- 54-35727, JP-A-55-26506 and JP-A-58-163940 disclose useful compounds; and bromide ions and the like may be used. Of these compounds, the compounds having a mercapto group or a disulfide group are preferred in view of their excellent bleach accelerating effects. Particularly, the compounds described in U.S. Pat. No. 3,893,858, West German Patent No. 1,290,812 and JP-A-53-95630 are preferred. Further, the compounds described in U.S. Pat. No. 4,552,834 are also preferred. These bleaching accelerators may be incorporated into sensitive materials. The accelerators are especially effective when bleaching-fixing color photographic sensitive materials for photographic use.

It is preferable that, besides the above compounds, an organic acid is included in the bleaching solution or the bleaching-fixing solution for preventing bleach stains. Especially preferable organic acids are compounds having an acid dissociation constant (pKa) of 2 to 5. Specific examples of such preferable compounds include acetic acid, propionic acid and hydroxyacetic acid.

Fixing agents which can be employed in the fixing solution or bleaching-fixing solution include thiosulfates, thiocyanates, thioether compounds, thioureas and a large amount of iodide. Among them, thiosulfates are generally employed. Particularly, ammonium thiosulfate is most widely employed. Combined use of thiosulfates with thiocyanates, with thioether compounds or with thioureas is also preferable. Preferable examples of preservatives for the fixing solution or the bleaching-fixing solution include sulfites, bisulfites, carbonylbisulfite adducts and sulfinic compounds described in EP-294,769A. Further, the fixing solution and bleaching-fixing solution preferably contain various aminopolycarboxylic acids and organic phosphonic acids for the purpose of stabilizing the solutions.

In the present invention, in order to regulate the pH, it is preferable that the bleaching solution and the bleaching-fixing solution contain 0.1 to 10 mol/liter of a compound having a pKa of 6.0 to 9.0, preferably, imidazols such as imidazol, 1-methylimidazol, 1-ethylimidazol or 2-methylimidazol.

It is preferable that the total time required for desilverization is short and is within a range in which defects of silver removal will not be caused. Preferably, the period of time for desilverization is 1 to 3 minutes, and more preferably from 1 to 2 minutes. The temperature at which the desilverization is performed is 25° to 50° C., preferably 35° to 45° C. Within the preferable range of temperature, the desilverization speed increases, and stains are effectively prevented from occurring after the desilverization step.

In the desilverization step, stirring is preferably intensified as much as possible. Specific examples of intensifying methods include a method of colliding a jet of the processing solution onto the surface of emulsion layers of sensitive materials described in JP-A-62-183460; a method of enhancing stirring efficiency by the use of a rotation means described in JP-A-62-183461; a method of further enhancing stirring efficiency by making use of turbulence generated in the surface of the emulsion by transferring the sensitive material while allowing wiper blades placed in the processing solution to contact the surface of the emulsion layers; and a method of increasing the circulating flow amount of the entire processing solution. These means for enhancing stirring performance are effective for any of the bleaching, bleaching-fixing or fixing solutions. The improvement in the stirring performance is thought to hasten the supply of the bleaching agents or fixing agents into the emulsion layers, leading to increase in the speed of desilverization. Further, the above-mentioned means for enhancing the stirring performance are more effective when a bleach accelerator is used. In this case, the accelerating effect can be significantly enhanced, and fixing inhibition action of the bleach accelerator can be eliminated.

Automatic developing apparatuses which are suited for use with the sensitive materials manufactured by using the emulsion of the present invention preferably have means for conveying sensitive materials described in JP-A-60-191257, JP-A-60-191258 and JP-A-60-191259. As described in JP-A-60-191257, such means can remarkably reduce the carrying of the processing solution from baths of earlier processes to baths of later processes, which provides an enhanced effect of preventing deterioration of performances of the processing solutions. Such an effect is especially advantageous in shortening the processing time of each step or in reducing the replenishing amount of the processing solution.

After the desilverizing step, the silver halide color photographic sensitive material manufactured using the emulsion of the present invention is generally subjected to a water washing step and/or a stabilizing step. The amount of rinsing water required for the water washing step may be determined over a wide range depending on the characteristics of sensitive materials (for example, materials used such as couplers), uses thereof, temperature of the rinsing water, the number of rinsing tanks (number of stages), the replenishing system such as countercurrent or direct flow current, or other various conditions. The relation between the number of rinsing tanks and the amount of the rinsing water in a multi-stage countercurrent system can be determined based on the method described in the Journal of the Society of Motion Picture and Television Engineers, Vol. 64, pp. 248–253 (May, 1955).

According to the multi-stage countercurrent system described in the above publication, the amount of the rinsing water can be substantially reduced. However, due to the increase in the time during which the water stays in the tank, bacteria propagate therein, resulting in the adhering of suspended matters to the sensitive material. The processing of color photographic sensitive materials according to the present invention can overcome this problem by effectively utilizing a method of reducing calcium and magnesium ions described in JP-A-62-288838. Further, it may be possible to employ isothiazolone compounds and thiabendazols disclosed in JP-A-57-8542; chlorine disinfectants such as chlorinated sodium isocyanurate; disinfectants such as benzotriazol, described in "Chemistry of Bacteria-Preventing Agents and Fungus-Preventing Agents" by Hiroshi HORIGUCHI, Sankyo Shuppan (1986), "Sterilization, Pasteurization and Fungus Prevention Techniques of Microorganisms" edited by Eisei Gijutsukai (1982), and "Dictionary of Disinfectants and Fungicides" edited by Kogyo Gijutsukai and Nippon Bohkin Bohbai Gakkai (1986).

The pH of the rinsing water for processing sensitive materials manufactured by using the emulsion of the present invention is in the range of 4 to 9, and preferably from 5 to 8. The temperature of the rinsing water and the washing time may be set in accordance with the characteristics of the sensitive material used and its use. In general, the setting may be from 20 seconds to 10 minutes at 15° to 45° C., preferably, 30 seconds to 5 minutes at 25° to 40° C. Further, the sensitive material of this invention Cain be directly processed with a stabilizing solution instead of rinsing water. For this stabilizing processing, known methods disclosed in JP-A-57-8543, JP-A-58-14834 and JP-A-60-220345 can be used.

A stabilizing process may follow the above-mentioned water-washing process. As an example, a stabilizing bath containing a dye stabilizer and a surfactant may be used as a final stage bath for processing color sensitive materials for photography. Examples of the dye stabilizers include aldehydes such as formalin and glutaraldehyde, N-methylol compounds, hexamethylenetetramine and adducts of aldehydes and sulfurous acid. Various chelating agents and antifungal agents may also be added to the stabilizing bath.

The overflow solution resulting from the above-mentioned water washing and/or the replenishment of the stabilizing solution can be reused in other steps such as desilverization process.

In processing by the use of an automatic developing apparatus or the like, if the processing solutions become concentrated due to evaporation, it is preferable to correct the concentration by adding water thereto.

The silver halide color photographic sensitive materials of the present invention may contain a color developing agent for the purpose of simplifying and expediting the processing. In order to incorporate the color developing agent, it is preferable to employ various precursors of color developing agents. Suitable examples of precursors of color developing agents include indoaniline type compounds described in U.S. Pat. No. 3,342,597; Schiff's base type compounds described in U.S. Pat. No. 3,342,599, RD No. 14850 and ibid. No. 15159; aldol compounds described in RD No. 13924; metal salt complexes described in U.S. Pat. No. 3,719,492; and urethane type compounds described in JP-A-53-135628.

The silver halide color sensitive materials utilizing the emulsion of the present invention may contain, if needed, various 1-phenyl-3-pirazolidones for the purpose of accelerating the color development. Examples of typical compounds include those disclosed in JP-A-56-64339, JP-A-57-144547 and JP-A-58-115438.

In the present invention, various processing solutions are employed in a temperature range from 10° to 50° C. Although standard temperatures are from 33° to 38° C., it is possible to carry out processing at higher temperatures in order to accelerate the processing so that the time required for processing is shortened, or at lower temperatures in order to improve image quality and to maintain stability of the processing solutions.

The silver halide color photographic sensitive materials of the present invention can be applied to sensitive materials for thermal development described, for example, in U.S. Pat. No. 4,500,626, JP-A-60-133449, JP-A-59-218443, JP-A-61-238056, and European Patent Application No. 210,660A2.

The silver halide color photographic sensitive materials of the present invention are useful when applied to lens-containing film units described, for example, in JP-B-2-32615 and Japanese Utility Model Application Publication 3-39784, and readily exhibit their effects.

EXAMPLES

The present invention will next be described in detail by way of examples, which should not be construed as limiting the invention.

Example 1

Preparation of Emulsions 1-A and 1-B (1) Preparation of emulsions:

1,200 ml of an aqueous solution containing 9 g of gelatin and 5 g of KBr were stirred at 60° C. An aqueous solution of $AgNO_3$ (7.3 g) and an aqueous solution of KBr (5.3 g) were added in double jets. 38 grams of gelatin were added and then the temperature was raised to 75° C. pAg was adjusted to 8.2. $AgNO_3$ (130 g) and a KBr solution were added. At that time pAg was maintained at 9.0. The resulting emulsion was cooled at 35° C. and washed by a conventional method (flocculation method). 50 grams of gelatin were added, and the pH and pAg of the mixture were adjusted to pH 5.5 and pAg 8.2.

The thus-obtained emulsion was used as a substrate grains, and was grown to the following two emulsions.

Tabular silver iodobromide emulsion 1-A (Comparative emulsion):

An emulsion 1-A which contained silver Lodobromide in an amount equivalent to 82 g $AgNO_3$ was added to 975 g of water to dissolve. The temperature, pAg, and pH were maintained at 40° C., 9.7, and 5.6, respectively.

An aqueous solution containing KI (3.4 g) was added at a constant flow rate for 5 minutes. Subsequently, $AgNO_3$ (35 g) and a KBr solution were added so that the pAg value was maintained at 9.2.

The emulsion was washed by a conventional flocculation method, and 32 g of gelatin were added. pH and pAg were adjusted to 6.2 and 8.6, respectively.

Tabular silver iodobromide emulsion 1-B (Comparative emulsion):

The procedure used for preparing emulsion 1-A was repeated except the following.

That is, instead of adding the aqueous KI solution, an aqueous solution of sodium p-iodoacetamide benzenesulfonate (7.8 g) was added. Subsequently, 0.80M of aqueous sodium sulfite solution (30 cc) was added. An aqueous NaOH solution was added to raise the pH to 9.0. The system was allowed to stand for 8 minutes, during which iodide ions were rapidly formed. Thereafter, pH was returned to 6.2. The time needed for 50% of the added p-iodoacetamide benzenesulfonate to completely release iodide ions was 10 seconds (time was measured from the point at which pH was raised to 9.0).

The temperature of the emulsion was elevated to 64° C., and the sensitizing dyes described in Example 2 below were added to the emulsion. That is, $2.6\times10^{-4}$ mol/mol Ag of ExS-1, $1.1\times10^{-5}$ mol/mol Ag of ExS-2, and $3.6\times10^{-4}$ mol/mol Ag of ExS-3 were first added. Thereafter, potassium thiocyanate, auric chloride, and sodium thiosulfate were added. Each of the dyes underwent optimal chemical sensitization.

Preparation of Emulsions 1-C and 1-K

To 1.4 1 of an aqueous solution containing 2.1 g of KBr and 7.6 g of gelatin, which was being stirred, were added an aqueous solution of $AgNO_3$ (containing 17.1 g of $AgNO_3$ in 100 ml) and an aqueous solution of a potassium halide (containing 11.3 g of KBr and 0.52 g of KI in 100 ml) by a double jetting method concurrently for 45 seconds (each 69.7 cc). The temperature was 40° C. After raising the temperature to 58° C., an aqueous gelatin solution (containing 35 g of gelatin and 284 cc of water) was added and the mixture was ripened for 30 minutes.

The thus-obtained seed crystals (substrate grains) were grown as described below, to prepare emulsions 1-C through 1-K.

Emulsion 1-C (Comparative emulsion):

(A) An aqueous silver nitrate solution (containing 72.8 g of silver nitrate) and an aqueous solution of potassium bromide were added at 58° C. for 20 minutes. pAg was maintained at 7.0.

(B) The temperature was dropped to 40° C., and thereafter, an aqueous silver nitrate solution (containing 8.4 g of silver nitrate) and an aqueous solution of potassium iodide (containing 8.3 g of potassium iodide) were added in double jets.

(C) Subsequently, an aqueous silver nitrate solution (containing 148.9 g of silver nitrate) and an aqueous solution of potassium bromide were added while maintaining the pAg value at 9.2.

The mixture was cooled to 35° C. and washed by a conventional flocculation method. 77 grams of gelatin was added. The pH and pAg were adjusted to 6.2 and 8.8, respectively.

The temperature of the emulsion was elevated to 64° C., and the sensitizing dyes described below were added to the emulsion. That is, $5.5\times10^{-4}$ mol/mol Ag of ExS-1, $1.6\times10^{-5}$ mol/mol Ag of ExS-2, and $5.5\times10^{-4}$ mol/mol Ag of ExS-3 were first added. After being allowed to stand for 10 minutes, $3.0\times10^{-5}$ mol/mol Ag of sodium thiosulfate, $3.4\times10^{-3}$ mol/mol Ag of potassium thiocyanate, and $9.0\times10^{-6}$ mol/mol Ag of auric chloride were added. Ripening was performed so that sensitivity was the highest after exposure of 1/100 seconds. The thus-obtained emulsion is referred to as emulsion 1-C.

Emulsion 1-D (Comparative emulsion):

The procedure used for preparing emulsion 1-C was repeated except the following.

(A) An aqueous silver nitrate solution (containing 147.2 g of silver nitrate) and an aqueous solution of potassium bromide were added at 58° C. pAg was maintained at 9.0.

(C) Subsequently, an aqueous silver nitrate solution (containing 74.5 of silver nitrate) and an aqueous solution of potassium bromide were added while maintaining the pAg value at 7.5.

The subsequent process was similar to that employed in the process for obtaining Emulsion 1-C.

Emulsion 1-E (Emulsion of the present invention):

The procedure used for preparing emulsion 1-C was repeated other than the following.

After the temperature was elevated to 40° C. in step (B), an aqueous solution of sodium p-iodoacetamide benzenesulfonate (19.4 g) was added. Subsequently, 0.8M of aqueous sodium sulfite solution (77 cc) was added. An aqueous NaOH solution was added to adjust the pH to 9.0. The system was allowed to stand for 8 minutes, during which iodide ions were formed. Thereafter, pH was returned to 5.0. 50 percents of the sodium p-iodoacetamide benzenesulfonate were decomposed in 10 seconds.

The subsequent process was similar to that employed in the process for obtaining Emulsion 1-C.

Emulsion 1-F (Emulsion of the present invention):

The procedure used for preparing emulsion 1-C was repeated except the following.

In step (A), the pAg value was maintained at 9.0 when an aqueous silver nitrate solution (containing 72.8 g of silver nitrate) and an aqueous solution of potassium bromide were added.

In step (C), an aqueous silver nitrate solution (containing 148.9 of silver nitrate) and an aqueous solution of potassium bromide were added while maintaining the pAg value at 7.5.

The subsequent process was similar to that employed in the process for obtaining Emulsion 1-C.

Emulsion 1-G (Emulsion of the present invention):

The procedure used for preparing emulsion 1-C was repeated except the following.

Before step (C), 0.3 grams of Pluronic (trademark, product of BASF) −31R1 (in the aforementioned compound A, x=x'=25, y=7), as is a polyalkylene oxide block copolymer, were added when nuclei were formed.

Emulsion 1-H (Emulsion of the present invention):

The procedure used for preparing emulsion 1-C was repeated except the following.

In step (A), the pAg value was maintained at 9.0 when an aqueous silver nitrate solution (containing 72.8 g of silver nitrate) and an aqueous solution of potassium bromide were added.

After the temperature was elevated to 40° C. in step (B), an aqueous solution of sodium p-iodoacetamide benzenesulfonate (19.4 g) was added. Subsequently, 0.8 Mols of aqueous sodium sulfite solution (77 cc) were added. An aqueous NaOH solution was added to adjust the pH to 9.0. The system was allowed to stand for 8 minutes, during which iodide ions were formed. Thereafter, pH was returned to 5.0.

In step (C), an aqueous silver nitrate solution (containing 148.9 of silver nitrate) and an aqueous solution of potassium bromide were added while maintaining the pAg value at 7.5.

The subsequent process was similar to that employed in the process for obtaining Emulsion 1-C.

Emulsion 1-I (Emulsion of the present invention):

The procedure used for preparing emulsion 1-C was repeated except the following.

In step (A), the pAg value was maintained at 9.0 when an aqueous silver nitrate solution (containing 72.8 g of silver nitrate) and an aqueous solution of potassium bromide were added.

Before step (C), 0.3 grams of Pluronic (trademark, product of BASF) −31R1 (in the aforementioned compound A, x=x'=25, y=7), as is a polyalkylene oxide block copolymer, were added when nuclei were formed. Subsequently, an aqueous silver nitrate solution (containing 148.9 of silver nitrate) and an aqueous solution of potassium bromide were added while maintaining the pAg value at 7.5.

The subsequent process was similar to that employed in the process for obtaining Emulsion 1-C.

Emulsion 1-J (Present invention):

The procedure used for preparing emulsion 1-C was repeated except the following.

After the temperature was elevated to 40° C. in step (B), an aqueous solution of sodium p-iodoacetamide benzenesulfonate (19.4 g) was added. Subsequently, 0.8M of aqueous sodium sulfite solution (77 cc) was added. An aqueous NaOH solution was added to adjust the pH to 9.0. The system was allowed to stand for 8 minutes, during which iodide ions were formed. Thereafter, pH was returned to 5.0.

Before step (C), 0.3 g of Pluronic (trademark, product of BASF) −31R1 (in the aforementioned compound A, x=x'=25, y=7), as is a polyalkylene oxide block copolymer, were added when nuclei were formed.

The subsequent process was similar to that employed in the process for obtaining Emulsion 1-C.

Emulsion 1-K (Emulsion of the present invention):

The procedure used for preparing emulsion 1-C was repeated except the following.

In step (A), the pAg value was maintained at 9.0 when an aqueous silver nitrate solution (containing 72.8 g of silver nitrate) and an aqueous solution of potassium bromide were added.

After the temperature was elevated to 40° C. in step (B), an aqueous solution of sodium p-iodoacetamide benzenesulfonate (19.4 g) was added. Subsequently, 0.8 Mols of aqueous sodium sulfite solution (77 cc) were added. An aqueous NaOH solution was added to adjust the pH to 9.0. The system was allowed to stand for 8 minutes, during which iodide ions were formed. Thereafter, pH was returned to 5.0.

Before step (C), 0.3 g of Pluronic (trademark, product of BASF) −31R1 (in the aforementioned compound A, x=x'=25, y=7), which is a polyalkylene oxide block copolymer, were added when nuclei were formed. Subsequently, an aqueous silver nitrate solution (containing 148.9 of silver nitrate) and an aqueous solution of potassium bromide were added while maintaining the pAg value at 7.5. The subsequent process was similar to that employed in the process for obtaining Emulsion 1-C.

The results of observation of dislocation lines, circular equivalent diameters, and aspect ratios are also shown. Emulsions 1-D through 1-K underwent optimal spectral sensitization and chemical ripening in the manner similar to that for emulsion 1-C.

(3) Preparation of coated samples and their evaluation

To a triacetate cellulose film support provided with an undercoat layer, emulsion layers shown in Table 1 and a protective layer were applied in amounts shown in Table A below to prepare coated samples 1 through 11.

TABLE A

| | | |
|---|---|---|
| (1) | Emulsion layer | |
| | Emulsions - a variety of emulsions (Table 1): | (silver: $3.6 \times 10^{-2}$ mol/m$^2$) |
| | Coupler | ($1.5 \times 10^{-3}$ mol/m$^2$) |

TABLE A-continued

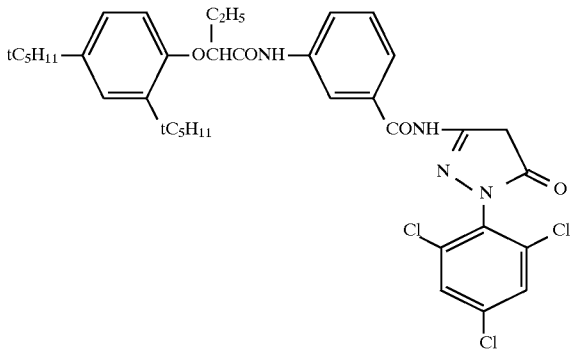

| | | |
|---|---|---|
| | Tricresylphosphate | (1.10 g/m$^2$) |
| | Gelatin | (2.30 g/m$^2$) |
| (2) | Protective layer | |
| | 2,4-Dichloro-6-hydroxy-s-triazine, sodium salt | (0.08 g/m$^2$) |
| | Gelatin | (1.80 g/m$^2$) |

The samples were left for 14 hours at 40° C. and relative humidity of 70%. Thereafter, the samples were exposed to light for 1/100 sec. through a continuous wedge. The samples were then subjected to color development shown in Table B.

The density of the processed samples were measured using green filters.

TABLE B

Color

| Processing step | Process time | Temp. |
|---|---|---|
| Development | 2 min. 0 sec | 40° C. |
| Bleaching/fixing | 3 min. 0 sec | 40° C. |
| Washing (1) | 20 sec. | 35° C. |
| Washing (2) | 20 sec. | 35° C. |
| Stabilizing | 20 sec. | 35° C. |
| Drying | 50 sec. | 65° C. |

The compositions of the respective processing solutions were as follows.

| | (g) |
|---|---|
| Color developing solution | |
| Diethylenetriaminepentaacetic acid | 2.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethylamino)-2-methylaniline sulfate | 4.5 |
| Total amount after adding water | 1.0 liter |
| pH | 10.05 |
| Bleaching/fixing solution | |
| Ethylenediamine tetraacetic ferric salt, ammonium.$2H_2O$ | 90.0 |
| Sodium ethylenediamine tetraacetate | 5.0 |
| Sodium sulfite | 12.0 |
| Aqueous solution of ammonium thiosulfate (70%) | 260.0 ml |
| Acetic acid (98%) | 5.0 ml |

-continued

| | (g) |
|---|---|
| Bleach accelerator 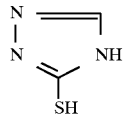 | 0.01 mol |
| Total amount after adding water | 1.0 liter |
| pH | 6.0 |

Washing water

Tap water was passed through a mixture-bed column filled with an H-type strongly acidic cation exchange resin (Amber light IR-120B, Rohm & Haas Co.) and an OH-type anion exchange resin (Amber light IR-400, Rohm & Haas Co.) to reduce the concentrations of calcium and magnesium ions not more than 3 mg/liter. Subsequently, 20 mg/liter of sodium dichloric isocyanurate and 1.5 g/liter of sodium sulfate were added thereto.

The pH of the resulting liquid was between 6.5 and 7.5.

| Stabilizing solution | (g) |
|---|---|
| Formalin (37%) | 2.0 ml |
| Polyoxyethylene-p-monononylphenyl ether (average polymerization degree: 10) | 0.3 |
| Disodium ethylenediaminetetraacetate | 0.05 |

-continued

| Stabilizing solution | (g) |
|---|---|
| Total amount after adding water | 1.0 liter |
| pH | 5.0–8.0 |

Sensitivity was represented in a relative fashion by a logarithm of inverse of the exposure amount represented by Lux.second which provided a fogging density of 0.2.

Grain characteristics were determined, after performing a uniform exposure which provided a fogging density of +0.2, by using the method described on page 619 in The Theory of the Photographic Process" (Macmillan Co.,).

Mar resistance was determined by the following test A. After the test, exposure for sensitometry was performed, and color development indicated in Table B was performed.

Test A:

In this test, a sample was placed in an atmosphere with a relative humidity of 55% for a period not less than 3 hours. Subsequently, in the same atmosphere, the emulsion surface of the sample was scratched under application of load (4 g) by a needle having a diameter of 0.1 mm at a speed of 1 cm/sec.

Using a measuring slit (5 $\mu$m×1 mm), densities of the developed sample were measured at portions to which pressure was applied and not applied. Increase in pressure fogging is represented by Δ Fog.

The results are in Tables 1 and 2.

TABLE 1

| | | Surface silver halide content (%) | pAg-low silver halide growth | Polyalkylene oxide block copolymer | Iodine ion releasing agent | Circle-equivalent diameter ($\mu$m) |
|---|---|---|---|---|---|---|
| 1-A | Comparative Example | 1.9 | 9.2 | — | — | 1.25 |
| 1-B | Comparative Example | 1.9 | 9.2 | — | 0 | 1.25 |

| | | Proportion of grains having dislocations only in fringe portions (%) | Proportion of grains having 10 or more dislocations (%) | Sensitivity | Grain characteristics | Fogging under pressure ΔFog |
|---|---|---|---|---|---|---|
| 1-A | Comparative Example | 85 | 78 | 100 | 100 | 100 |
| 1-B | Comparative Example | 87 | 82 | 103 | 105 | 96 |

TABLE 2

| | | Surface silver halide content (%) | pAg-low silver halide growth | Polyalkylene oxide block copolymer | Iodine ion releasing agent | Circle-equivalent diameter ($\mu$m) |
|---|---|---|---|---|---|---|
| 1-C | Comparative Example | 2.3 | 9.2 | — | — | 0.42 |
| 1-D | Comparative Example | 5.1 | 7.5 | — | — | 0.41 |
| 1-E | Present Invention | 2.3 | 9.2 | — | 0 | 0.41 |
| 1-F | Present Invention | 2.4 | 7.5 | — | — | 0.42 |

TABLE 2-continued

| | | | | | | |
|---|---|---|---|---|---|---|
| 1-G | Present Invention | 2.2 | 9.2 | 0 | — | 0.41 |
| 1-H | Present Invention | 2.4 | 7.5 | — | 0 | 0.41 |
| 1-I | Present Invention | 2.3 | 7.5 | 0 | — | 0.43 |
| 1-J | Present Invention | 2.1 | 9.2 | 0 | 0 | 0.42 |
| 1-K | Present Invention | 2 | 7.5 | 0 | 0 | 0.41 |

| | | Proportion of grains having dislocations only in fringe portions (%) | Proportion of grains having 10 or more dislocations (%) | Sensitivity | Grain characteristics | Fogging under pressure ΔFog |
|---|---|---|---|---|---|---|
| 1-C | Comparative Example | 42 | 35 | 100 | 100 | 100 |
| 1-D | Comparative Example | 61 | 53 | 57 | 87 | 96 |
| 1-E | Present Invention | 63 | 53 | 108 | 115 | 94 |
| 1-F | Present Invention | 63 | 58 | 110 | 117 | 95 |
| 1-G | Present Invention | 64 | 55 | 107 | 114 | 94 |
| 1-H | Present Invention | 88 | 72 | 120 | 119 | 68 |
| 1-I | Present Invention | 85 | 75 | 135 | 123 | 62 |
| 1-J | Present Invention | 86 | 80 | 133 | 125 | 60 |
| 1-K | Present Invention | 95 | 83 | 163 | 133 | 21 |

In Table 1, sensitivities, grain characteristics, and pressure foggings of sample 1-B are shown by values relative to the sensitivity of sample 1-A (=100).

In Table 2, sensitivities, grain characteristics, and pressure foggings of samples 1-C through 1-K are shown by values relative to the sensitivity of sample 1-C (=100).

Proportions of fringe dislocation-type tabular grains and principal plane dislocation-type tabular grains were obtained by observing 200 emulsion-grains from each emulsion (grains were observed while samples were tilted in four steps, −5°, 0°, +5°, +10°).

Figure 2:
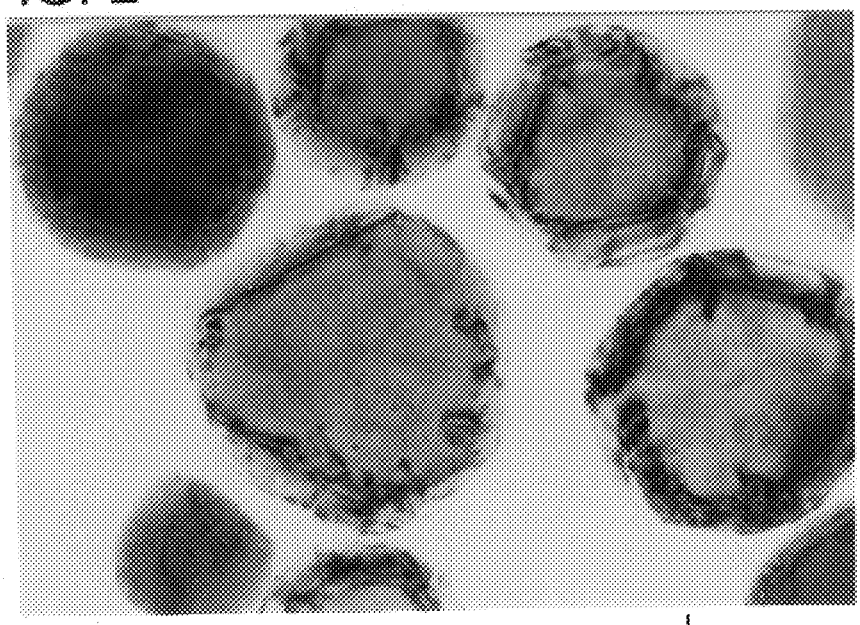
FIG. 2 is an electron micro graph showing the structure of emulsion particles obtained in an example of the present invention.

The electron micrographs of the emulsions of samples 1-C and 1-F are shown in FIGS. 1 and 2.

As is apparent from FIG. 1, grains 1-F in the present invention have highly dense dislocations in fringe portions as compared with 1-C grains. Moreover, as is apparent from Table 2, iodine ion releasing agents are effective for large grains having a circle-equivalent diameter of not less than 0.6 μm. However, conventional methods, such as for grains 1-A, widely known in the art also make it possible to introduce dislocations only in fringe portions.

By contrast, in case of small grains having a circle-equivalent diameter of not more than 0.6 μm, conventional methods failed to introduce sufficient amounts of dislocations only in fringe portions as seen from 1-C. Moreover, when the silver content in fringe portions was decreased as in 1-D, dislocations could be introduced to fringe portions. However, surface silver iodide content increased, causing a low sensitivity.

Thus, according to conventional techniques, if a high silver iodide phase is introduced within grains in an attempt to reduce the surface silver iodide content, dislocations cannot be introduced in fringe portions. When the amount of dislocations in fringe portions is desired to be increased, it results in increase in the silver iodide content in surfaces. Therefore, conventional methods were not able to make small grains having dislocations only in fringe portions and a reduced amount of silver iodide in surfaces.

In contrast, according to the present invention, small grains having dislocations only in fringe portions with reduced amounts of surface silver iodide were prepared, as seen in samples 1-E through 1-K. They have excellent sensitivity, granularity characteristics, and antifogging under pressure. Moreover, in samples 1-H through 1-J, which were prepared by combining two of the manners of the invention, advantageous effects greater than those obtained from the single use were obtained. Surprisingly, in simple 1-K, which was obtained by combining all three manners, more advantageous effects were obtained.

Example 2

1) Support

The support used in the present invention was prepared as follows.

100 parts by weight of commercially available polyethylene-2,6-naphthalate polymer and 2 parts by weight of a UV absorber, Tinuvin P.326 (manufacture by Geigy) were dried by a conventional method. The resulting mixture was melted at 300° C., extruded from a T-dye, and longitudinally stretched (x 3.0). Subsequently, transversal stretching (x 3.0) at 130° C. was performed. After thermal setting at 250° C. for 6 seconds, a PEN film having a thickness of 90 μm was obtained.

A part of the film was wound on a stainless steel rod having a diameter of 20 cm, and a thermal hysteresis was applied thereto at 110° C. for 48 hours.

2) Undercoating

The above support was subjected to corona discharge treatment, UV discharge treatment, glow treatment, and flame treatment on both surfaces. Each surface was coated with an undercoat liquid described below. The undercoat layer was provided on the high temperature side during stretching. In performing corona discharge treatment, solid state corona processor 6 KVA model manufactured by Pillar Co., was used. The support having a 30 cm width was processed at a rate of 20 m/min. From the current and voltage readings, the treated film had undergone a treatment of 0.375 KV·A·min/$m^2$. The electric discharge frequency at the time of treatment was 9.6 KHz, the gap clearance between the electrodes and the dielectric roll was 1.6 mm. The UV discharge treatment was performed while heating the film at 75° C. The glow discharge treatment was performed using a columnar electrode under conditions of 300 W for 30 seconds.

| | |
|---|---|
| Gelatin | 3 g |
| Distilled water | 25 cc |
| Sodium α-sulfodi-2-ethylhexylsuccinate | 0.05 g |
| Formaldehyde | 0.02 g |
| Salicylic acid | 0.1 g |
| Diacetylcellulose | 0.5 g |
| p-Chlorophenol | 0.5 g |
| Resorcin | 0.5 g |
| Cresol | 0.5 g |
| $(CH_2{=}CHSO_2CH_2CH_2NHCO)_2CH_2$ | 0.2 g |
| Trimethylpropane triazine | 0.2 g |
| Trimethylolpropane tristoluene diisocyanate | 0.2 g |
| Methanol | 15 cc |
| Acetone | 85 cc |
| Formaldehyde | 0.01 g |
| Acetic acid | 0.01 g |
| Conc. hydrochloric acid | 0.01 g |

3) Coating of backing layers

On one surface of the under-coated support, backing layers were provided which consist of an antistatic layer, a magnetic recording layer, and a slipping layer.

3-1) Antistatic layer 3-1-1) Preparation of a conductive fine powder dispersion (stannic oxide—antimony oxide complex dispersion):

230 parts by weight of hydrated stannic chloride and 23 parts by weight of antimony trichloride were dissolved in 3,000 parts by weight of ethanol, to obtain a uniform solution. An aqueous 1N NaOH solution was added dropwise until the pH of the solution reached 3. As a result, colloidal stannic oxide and antimony oxide was co-precipitated. The resulting coprecipitation was allowed to stand at 50° C. for 24 hours, to obtain a reddish brown colloidal coprecipitation.

This reddish brown coprecipitation was centrifugally separated. In order to remove excessive ions, water was added and washing was performed by way of centrifugation. This operation was repeated 3 times, thereby removing excessive ions.

200 parts by weight of the colloidal precipitation from which excessive ions were removed were re-dispersed to make 1,500 parts by weight, and sprayed into a kiln heated at 650° C. Bluish very fine grains of stannic oxide—antimony oxide complex having an average grain size of 0.005 μm were obtained. The resistivity of the resulting very fine grains was 5 ohm·cm.

40 parts by weight of the fine powdery grains and 60 parts by weight of water were mixed and the pH of the mixture was adjusted to 7.0. After the mixture was roughly dispersed with a stirrer, a transversal sand mill (Dainomill-trademark, Willya. Bachofenag) was used to make a dispersion until a residence time reached 30 minutes. The average diameter of secondary coagulation was about 0.04 μm.

3-1-2) Coating of an conductive layer:

A composition having the following formula was applied to the above so that the thickness of the dry film was 0.2 μm. The resulting film was dried at 115° C. for 60 seconds.

Conductive fine grain dispersion obtained in 3-1-1):

| | |
|---|---|
| Conductive fine grain dispersion obtained in 3-1-1): | 20 parts by weight |
| Gelatin | 2 parts by weight |
| Water | 27 parts by weight |
| Methanol | 60 parts by weight |
| p-Chlorophenol | 0.5 parts by weight |
| Resorcin | 2 parts by weight |
| Polyoxyethylene nonylphenylether | 0.01 parts by weight |

The resistance of the resulting conductive film was $10^{8.0}$ (100 V), exhibiting excellent antistatic properties.

3-2) Magnetic recording layer:

1,100 g of a magnetic substance, Co-coated gamma $Fe_2O_3$ (needles having a major axis of 0.14 μm and a minor axis of 0.03 μm, specific surface area: 41 $m^2$/g, saturated magnetization: 89 emu/g, the surfaces, aluminum oxide and silicon oxide were treated with 2% by weight of $Fe_2O_3$, coercive force: 930 Oe, $Fe^{+2}/Fe^{+3}$=6/94) was combined with 220 g of water and 150 g of a coupling agent, poly(polymerization degree=16)oxyethylenepropyl trimethoxysilane. The resulting mixture was kneaded well with an open kneader for 3 hours to obtain a roughly dispersed viscous liquid. It was dried over night and day at 70° C. to remove water. Subsequently, it was thermally treated at 110° C. for 1 hour, to obtain coated magnetic particles.

Next, the following composition was formulated and kneaded in an open kneaded again.

| | |
|---|---|
| The surface-treated magnetic particles | 1,000 g |
| Diacetylcellulose | 17 g |
| Diethylketone | 100 g |
| Cyclohexanone | 100 g |

Further, the following composition was prepared and dispersed minutely using a sand mill (¼ G) at 200 rpm for 4 hours.

| | |
|---|---|
| The kneaded material obtained above | 100 g |
| Diacetylcellulose | 60 g |
| Methyl ethyl ketone | 300 g |
| Cyclohexanone | 300 g |

To the resulting dispersion, diacetylcellulose and a setting agent, $C_2H_5C(CH_2OCONH{-}C_6H_3(CH_3)NCO)_3$ were added in an amount of 20 wt % based on the weight of the binder. The resulting liquid was diluted with equivalent amounts of methyl ethyl ketone and cyclohexanone so that the viscosity was about 80 cp. The diluted liquid was applied on the aforementioned conductive layer using a bar coater, the film thickness was 1.2 μm. The coating was performed so that the amount of the magnetic substance was 0.6 g/$m^2$. As a matting agent, silica particles (0.3 μm) and an abrasive, aluminum oxide (0.5 μm) were added each in amounts of 10 mg/$m^2$. Drying conditions were at 115° C. for 6 minutes (the rollers and conveyors in the drying zone were all set to 115° C.).

The increment in color density of $D^8$ in the magnetic recording layer was approximately 0.1 when the measurement was performed under conditions of X-light, status M, and use of a blue filter. Saturated magnetization moment of the magnetic recording layer was 4.2 emu/$m^2$, coercive force was 923 Oe, and the square ratio was 65%.

3-3) Lubricating layer

A liquid formulated as follows was applied the above so as to have solid amounts as indicated below. Drying was performed at 110° C. for 5 minutes, to obtain a lubricating layer.

| | |
|---|---|
| Diacetylcellulose | 25 mg/m$^2$ |
| $C_6H_{13}CH(PH)C_{10}H_{20}COOC_{40}H_{81}$:compound a | 6 mg/m$^2$ |
| $C_{50}H_{101}O(CH_2CH_2O)_{16}H$:compound b | 9 mg/m$^2$ |

The compound a/compound b (6:9) was added to equivalent amounts of xylene and propylene glycol monomethyl ether (volume ratio: 1:1) and heated at 105° C. to dissolve. The resulting liquid was poured into 10 times the amount of propylene glycol monoether (25° C.) to prepare an emulsion of very fine grains. Further, the dispersion was diluted with 5 times the amount of acetone, and redispersed with a high pressure homogenizer (200 atm), to obtain a dispersion having an average grain size of 0.01 $\mu$m.

This dispersion was used for addition for preparing a lubricant layer.

The resulting lubricant layer had a dynamic friction coefficient of 0.06 (stainless steel balls having a diameter of 5 mm, load: 100 g, and speed: 6 cm/min), static friction coefficient of 0.07 (clipping method), thus exhibiting excellent performance. As to the sliding friction with respect to the emulsion layer described below, the dynamic friction coefficient was 0.1.

4) Sensitive layer:

On the opposite side of the backing layers obtained as described above, the following compositions were applied inlayers one on another, to obtaining a color negative film.

On the third layer (low-sensitive red-sensitive emulsion layer) contained any one of emulsions 1-C to 1-K described in Example 1. They are referred to as sample 101 to 109.

Compositions of sensitive layers:

Major materials used in respective layers are categorized as follows. The specific structures of them are collectively described later.

ExC: Cyan coupler

ExM: Magenta coupler

ExY: Yellow coupler

ExS: Sensitizing dye

ExF: Dye

UV: UV absorber

HBS: High-boiling point organic material

H: Gelatin setting agent

The figures corresponding to the respective components also indicate the coating amounts by a unit g/m$^2$. As to silver halides, coating amounts converted to an amount of silver. Amounts of sensitizing dyes are indicated by the amounts applied to 1 mol of the same amounts of silver halide.

(Sample 101)

| | | |
|---|---|---|
| First layer (Antihalation layer) | | |
| Black colloidal silver | Silver | 0.09 |
| Gelatin | | 1.60 |
| ExM-1 | | 0.12 |
| ExF-1 | | $2.0 \times 10^{-3}$ |
| Solid dispersion dye ExF-2 | | 0.030 |
| Solid dispersion dye ExF-3 | | 0.040 |
| HBS-1 | | 0.15 |
| HBS-2 | | 0.02 |

-continued (Sample 101)

| | | |
|---|---|---|
| Second layer (Intermediate layer) | | |
| Silver iodobromide emulsion M (See Table 3 described beiow) | Silver | 0.065 |
| ExC-2 | | 0.04 |
| Polyethylacrylate latex | | 0.02 |
| Gelatin | | 1.04 |
| Third layer (Low-sensitive red-sensitive emulsion layer) | | |
| Emulsion described in Example 1 | Silver | 0.50 |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 0.87 |
| Fourth layer (Intermediate-sensitive red-sensitive emulsion layer) | | |
| Silver iodobromide emulsion C | Silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatin | | 0.75 |
| Fifth layer (High-sensitive red-sensitive emuision layer) | | |
| Silver iodobromide emulsion D | Silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.50 |
| HBS-1 | | 0.22 |
| HBS-2 | | 0.050 |
| Gelatin | | 1.10 |
| Sixth layer (Intermediate layer) | | |
| Cpd-1 | | 0.090 |
| Solid dispersion dye ExF-4 | | 0.030 |
| HBS-1 | | 0.050 |
| Polyethylacrylate latex | | 0.15 |
| Gelatin | | 1.10 |
| Seventh layer (Low-sensitive green-sensitive emulsion layer) | | |
| Silver iodobromide emulsion E | Silver | 0.15 |
| Silver iodobromide emulsion F | Silver | 0.10 |
| Silver iodobromide emulsion G | Silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-6 | | 0.015 |
| HBS-1 | | 0.30 |
| HBS-2 | | 0.010 |
| Gelatin | | 0.73 |
| Eighth layer (Intermediate-sensitive green-sensitive emulsion layer) | | |
| Silver iodobromide emulsion H | Silver | 0.80 |
| ExS-4 | | $3.2 \times 10^{-5}$ |
| ExS-5 | | $2.2 \times 10^{-4}$ |

-continued (Sample 101)

| | |
|---|---|
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |
| Ninth layer (High-sensitive green-sensitive emulsion layer) | |
| Silver iodobromide emulsion I | Silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethylacrylate latex | 0.15 |
| Gelatin | 1.33 |
| Tenth layer (Yellow filter layer) | |
| Yellow colloidal silver | Silver 0.015 |
| Cpd-1 | 0.16 |
| Solid dispersion dye ExF-5 | 0.080 |
| Solid dispersion dye ExF-6 | 0.060 |
| Oil-soluble paint ExF-7 | 0.010 |
| HBS-1 | 0.60 |
| Gelatin | 0.60 |
| Eleventh layer (Low-sensitive blue-sensitive emulsion layer) | |
| Silver iodobromide emulsion J | Silver 0.09 |
| Silver iodobromide emulsion K | Silver 0.09 |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| Gelatin | 1.20 |

-continued (Sample 101)

| | |
|---|---|
| Twelveth layer (High-sensitive blue-sensitive emulsion layer) | |
| Silver iodobromide emulsion L | Silver 1.00 |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| Thirteenth layer (First protective layer) | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.8 |
| Fourteenth layer (Second protective layer) | |
| Silver iodobromide emulsion M | Silver 0.10 |
| H-1 | 0.40 |
| B-1 (Diameter 1.7 $\mu$m) | $5.0 \times 10^{-2}$ |
| B-2 (Diameter 1.7 $\mu$m) | 0.15 |
| B-3 | 0.05 |
| S-1 | 0.20 |
| Gelatin | 0.70 |

In order to improve storability, processability, pressure durability, mildew proofing/antifungal properties, antistatic properties, and coating easiness, respective layers contain W-1 to W-3, B-4 to B-6, F-1 to F-17, iron salts, lead salts, gold salts, platinum salts, palladium salts, iridium salts, and rhodium salts.

TABLE 3

| | Average AgI content (%) | Coefficient in variation related to AgI content among grains (%) | Average grain size (sphere-equivalent diameter) ($\mu$m) | Coefficent in variation related to grain size (%) | Projected area (circule-equivalent diameter) ($\mu$m) | Diameter/thickness ratio |
|---|---|---|---|---|---|---|
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

In Table 3, the following should be noted.

(1) Emulsions J to L had undergone reduction sensitization using thiourea dioxide and thiosulfonic acid in accordance with JP-A-2-191,938.

(2) Emulsions C to I had undergone gold sensitization, sulfur sensitization, and selenium sensitization in the presence of spectral sensitizing dyes and sodium thiocyanate, in accordance with JP-A-3-237,450.

(3) In preparing tabular grains, low-molecular weight gelatin was used in accordance with JP-A-1-158,426.

(4) Grains of emulsion L were double structured grains each having a high iodine core as described in JP-A-60-143,331.

Preparation of a dispersion of organic solid dyes:

The ExF-2 was dispersed according to the following method. That is, 21.7 ml of water, 3 ml of an aqueous 5% Na p-octylphenoxyethoxy ethane sulfonate, and 0.5 g of an aqueous 5% p-octylphenoxy polyoxyethylene ether (polymerization degree: 10) were charged in a 700 ml pot mill. 5.0 g of the dye ExF-2 and zirconium oxide beads (diameter: 1 mm) were subjected to a dispersing process for 2 hours. A BO-type vibration ball mill manufactured by Chuo Koki Ltd. was used. After completion of dispersion, the content was taken out and added to 8 g of an aqueous 12.5% gelatin solution. Beads were removed by filtration, to obtain a dye-in-gelatin dispersion. The mean size of the dye particles was 0.44 $\mu$m.

In a similar manner, solid dispersions of ExF-3, ExF-4, and ExF-6 were obtained. The mean sizes of the resulting dyes particles were 0.24 $\mu$m, 0.45 $\mu$m, and 0.52 $\mu$m, respectively. ExF-5 was dispersed by a microprecipitation dispersing method described in Example 1 of EP-549,489-A. The mean particle size was 0.06 $\mu$m.

ExC-1

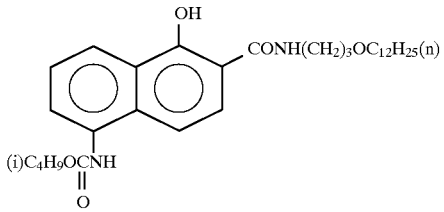

ExC-2

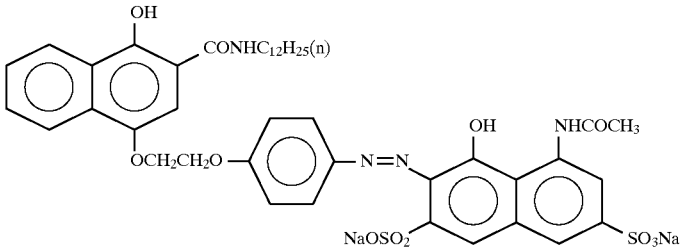

ExC-3

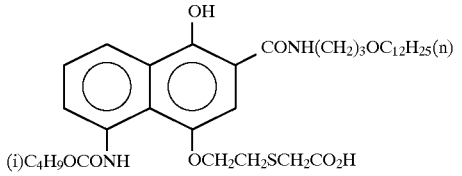

ExC-4

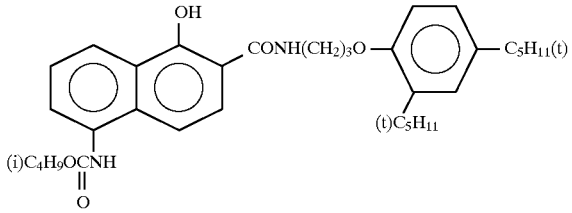

ExC-5

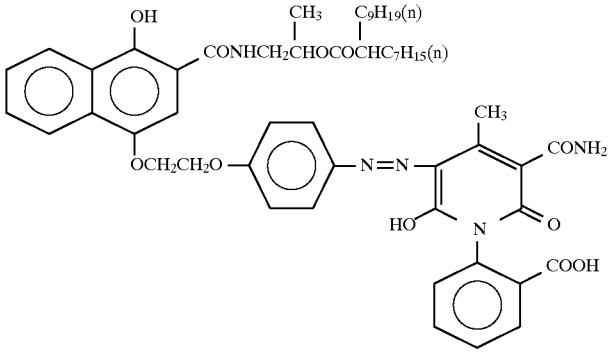

-continued
ExC-6
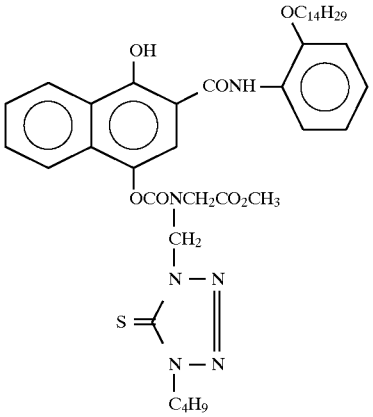
ExC-7
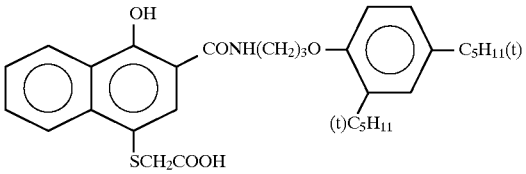
ExC-8
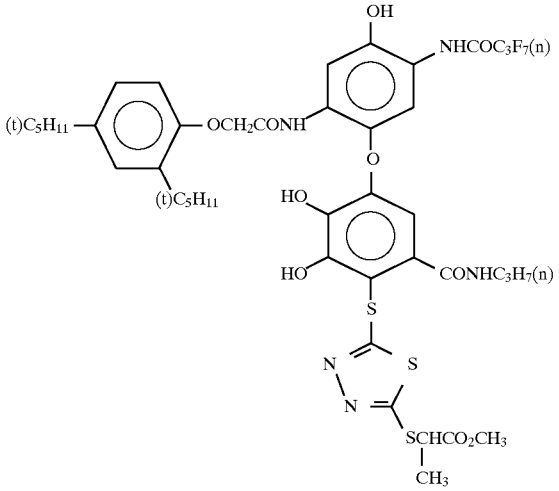
ExM-1
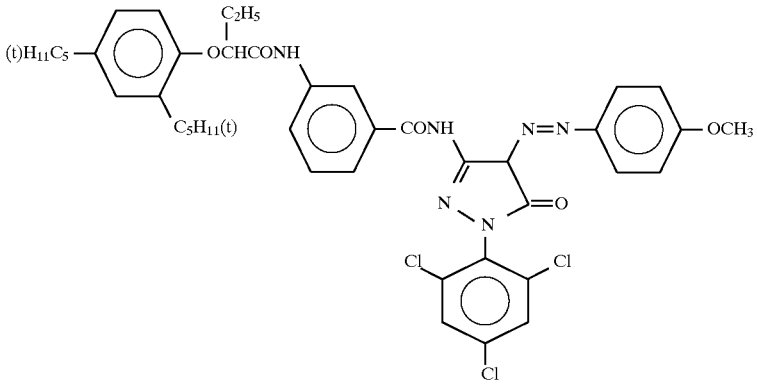

-continued
ExM-2
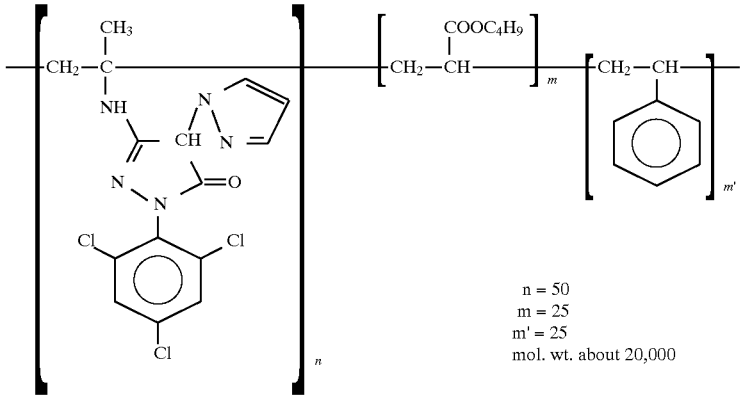
n = 50
m = 25
m' = 25
mol. wt. about 20,000
ExM-3
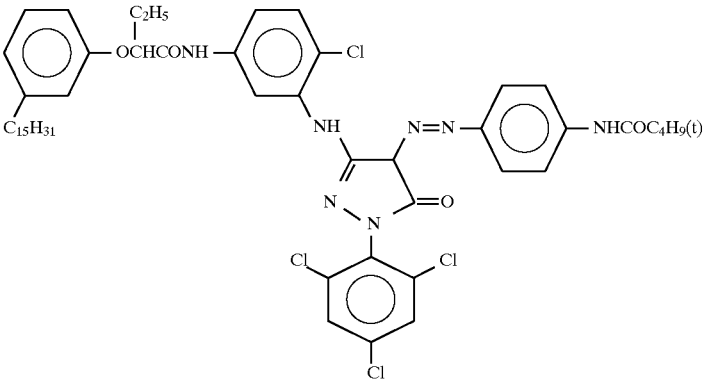
ExM-4
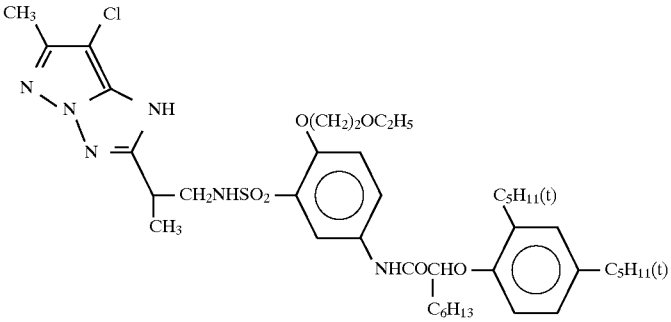
ExM-5
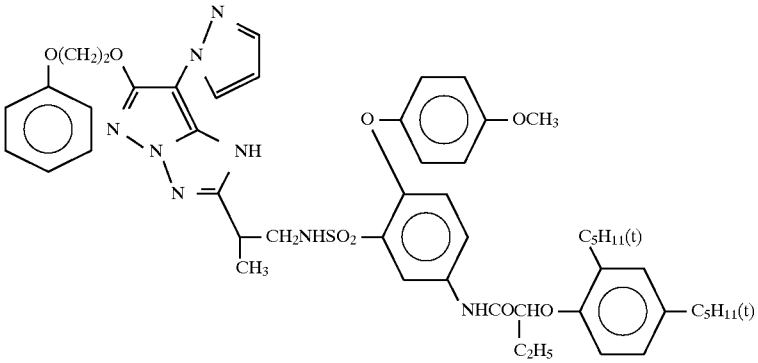

-continued
ExY-1
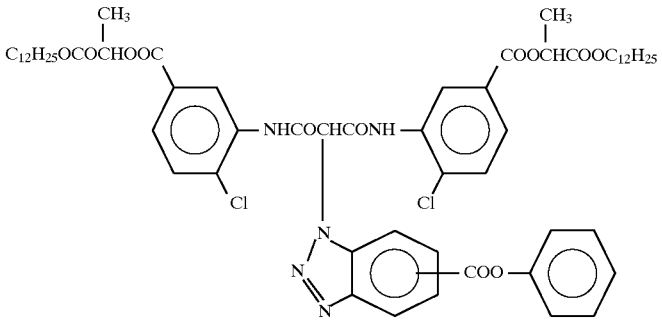
ExY-2
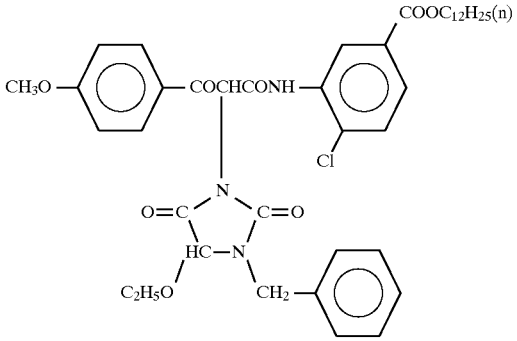
ExY-3
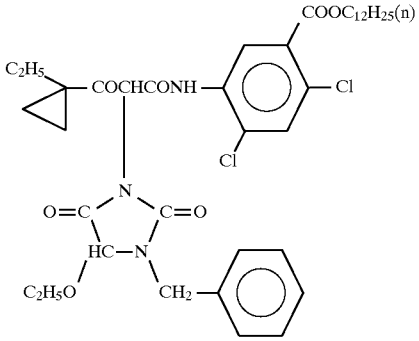
ExY-4
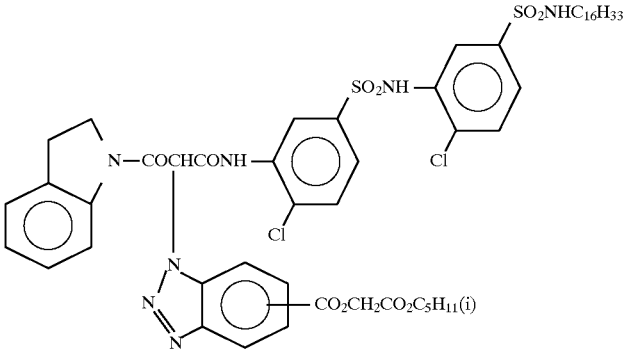

-continued
ExY-5
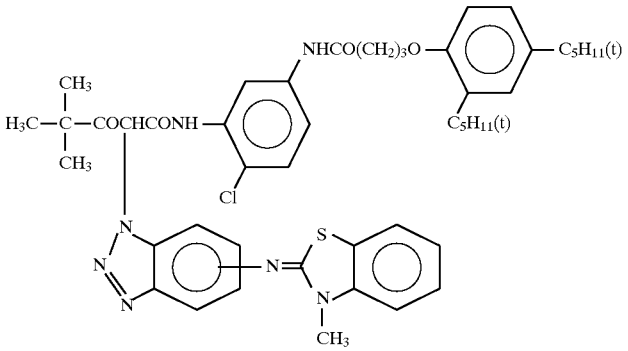
ExF-1
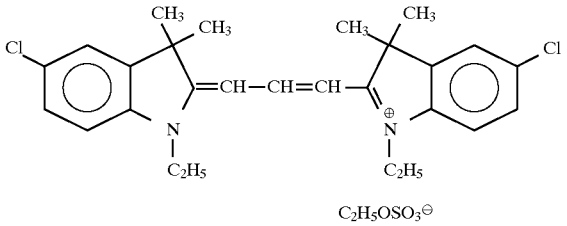
ExF-2
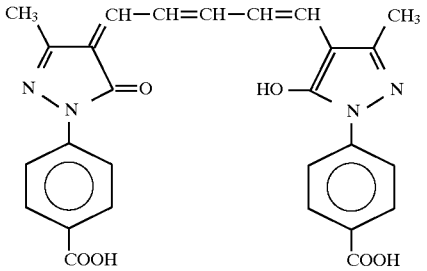
ExF-3
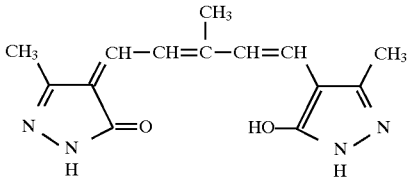
ExF-4
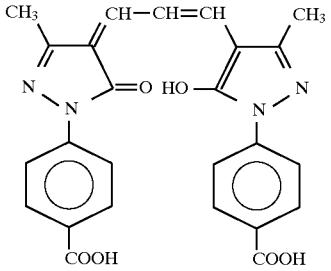
ExF-5
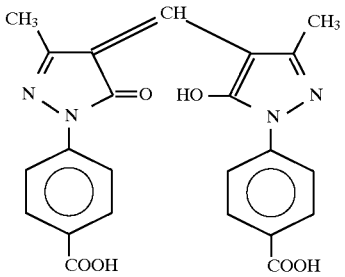

-continued
ExF-6
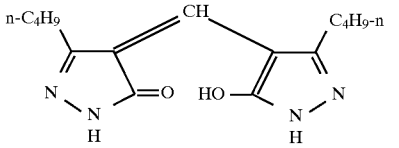
ExF-7
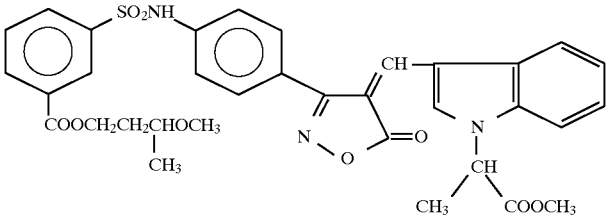
Cpd-1
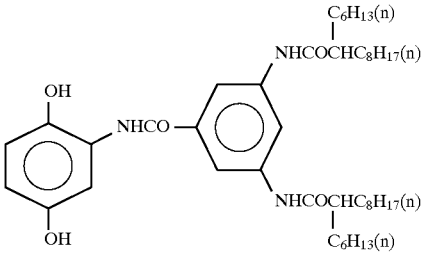
Cpd-2
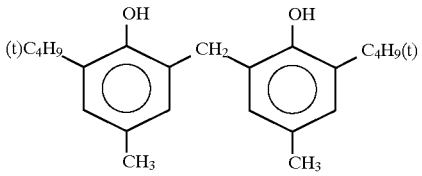
Cpd-3
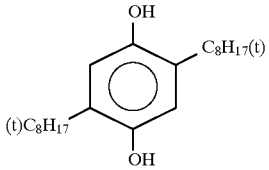
UV-1
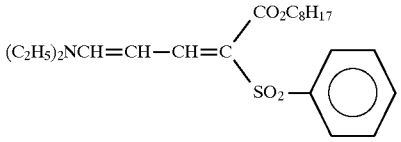
UV-2
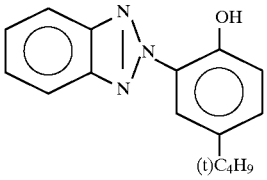
UV-3
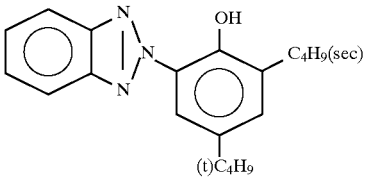
TRICRESYLPHOSPHATE HBS-1
Di-n-DIBUTYLPHTHALATE HBS-2

-continued
HBS-3
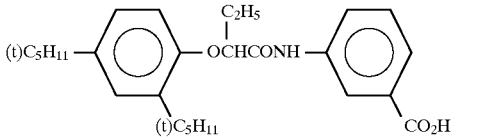
TRI(2-ETHYLHEXYL)PHOSPHATE HBS-4
ExS-1
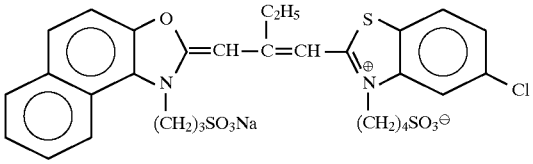
ExS-2
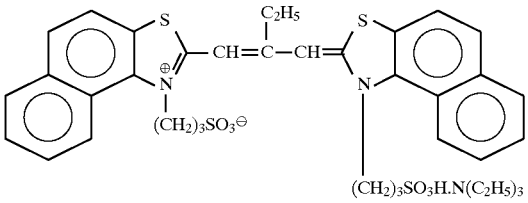
ExS-3
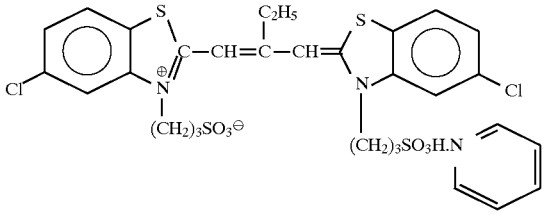
ExS-4
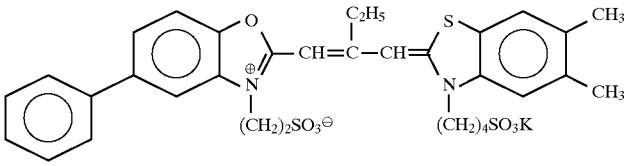
ExS-5
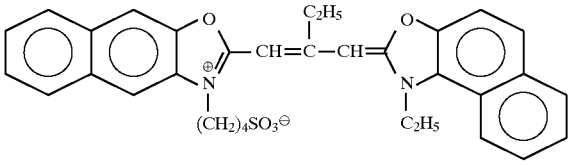
ExS-6
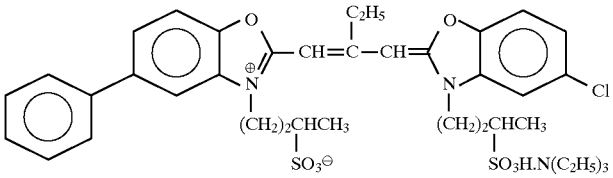
ExS-7
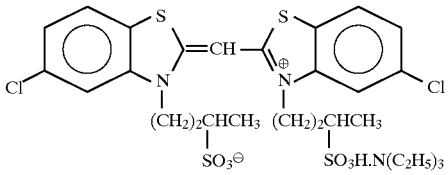
S-1
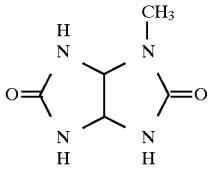

-continued
H-1
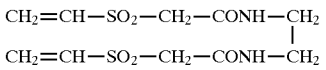
B-1
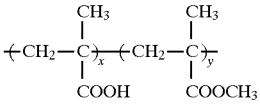
x/y = 10/90
B-2
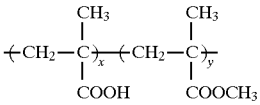
x/y = 40/60
B-3
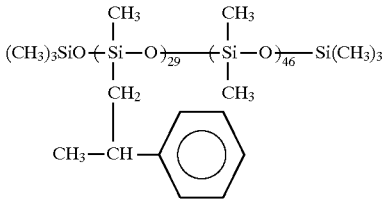
B-4
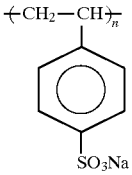
B-5
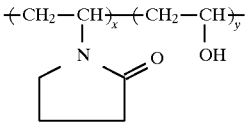
x/y = 70/30
B-6
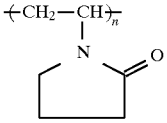
(mol. wt. about 10,000)
W-1
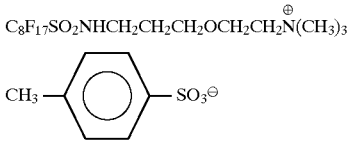
W-2
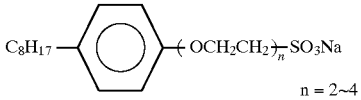
n = 2~4
W-3
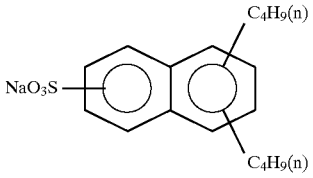
F-1
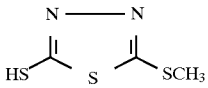

-continued
F-2
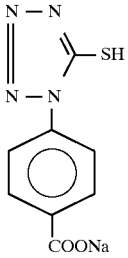
F-3
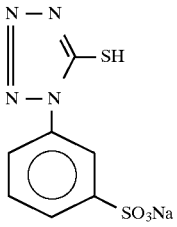
F-4
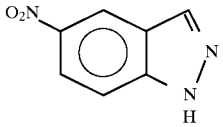
F-5
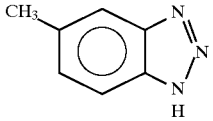
F-6
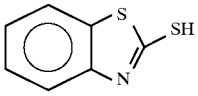
F-7
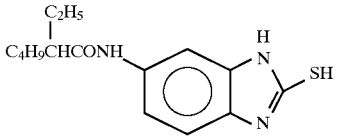
F-8
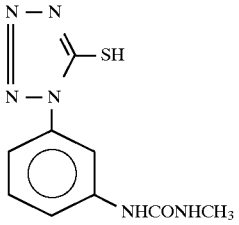
F-9
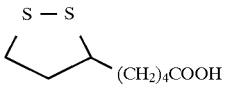
F-10
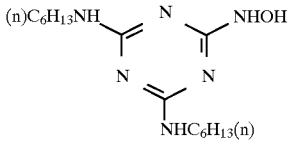
F-11
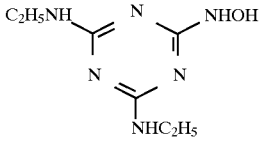

-continued

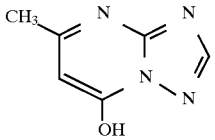

F-12

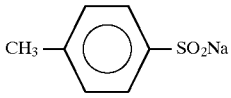

F-13

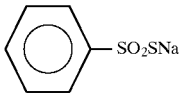

F-14

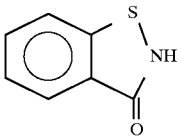

F-15

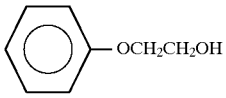

F-16

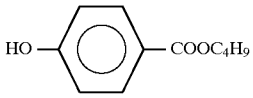

F-17

These samples were allowed to stand at 40° C. and relative humidity of 70% for 14 hours. Subsequently, the samples were exposed to white light for 1/100 seconds. A color developing processing as in Example 1 was performed. The color developing time was 3 min. 15 sec.

The samples 101 to 109 thus obtained were exposed to light, and processed as shown in Table C.

TABLE C

Method of processing

| Processing step | Process time | Temp. |
|---|---|---|
| Development | 3 min. 15 sec. | 38° C. |
| Bleaching | 1 min. 00 sec. | 38° C. |
| Bleaching/fixing | 3 min. 15 sec. | 38° C. |
| Washing (1) | 40 sec. | 35° C. |
| Washing (2) | 1 min. 00 sec. | 35° C. |
| Stabilizing | 40 sec. | 38° C. |
| Drying | 1 min. 15 sec. | 55° C. |

The compositions of the respective processing solutions were as follows.

| | (g) |
|---|---|
| Color developing solution | |
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethylamino)-2-methylaniline sulfate | 4.5 |

-continued

| | (g) |
|---|---|
| Total amount after adding water | 1.0 liter |
| pH | 10.05 |
| Bleaching | |
| Ethylenediamine tetraacetic ferric salt, ammonium.$H_2O$ | 120.0 |
| Disodium ethylenediamine tetraacetate | 10.0 |
| Ammonium bromide | 100.0 |
| Ammonium nitrate | 10.0 |
| Bleach accelerator $((CH_2)_2N—CH_2—CH_2—S—)_2.2HCl$ | 0.005 mol |
| Ammonia water (27%) | 15.0 ml |
| Total amount after adding water | 1.0 liter |
| pH | 6.3 |
| Bleaching/fixing solution | |
| Ethylenediamine tetraacetic ferric salt, ammonium.$H_2O$ | 50.0 |
| Disodium ethylenediamine tetraacetate | 5.0 |
| Sodium sulfite | 12.0 |
| Aqueous solution of ammonium thiosulfate (70%) | 240.0 ml |
| Ammonia water (27%) | 6.0 ml |
| Total amount after adding water | 1.0 liter |
| pH | 7.2 |

Washing water

Tap water was passed through a mixture-bed column filled with an H-type strongly acidic cation exchange resin (Amber light IR-120B, Rohm & Haas Co.) and an OH-type anion exchange resin (Amber light IR-400, Rohm & Haas Co.) to reduce the concentrations of calcium and magnesium ions not more than 3 mg/liter. Subsequently, 20 mg/liter of sodium dichloric isocyanurate and 0.15 g/liter of sodium sulfate were added thereto. The pH of the resulting liquid was between 6.5 and 7.5.

| Stabilizing solution | (g) |
|---|---|
| Formalin (37%) | 2.0 ml |
| Polyoxyethylene-p-monononylphenyl ether (average polymerization degree: 10) | 0.3 |
| Disodium ethylenediaminetetraacetate | 0.05 |
| Total amount after adding water | 1.0 liter |
| pH | 5.0–8.0 |

Characteristic curves of cyan dyes were used to obtain relative sensitivities by an inverse of the exposure that provided density of 1.8. Also, as in Example 1, a uniform exposure of giving a density of 1.8 was performed, and granularity characteristics were determined.

Pressure characteristics were determined by test A as in Example 1. After processes of exposure and development, densities of the portions to which pressure was applied or not applied were measured with respect to the characteristic curves of cyan dyes. Increment in pressure fogging is represented by Δ Fog.

The results are in Table 4.

TABLE 4

| | Sensitivity | Grain characteristics | Fogging under pressure ΔFog | |
|---|---|---|---|---|
| 101 | 100 | 100 | 100 | Comparative Example |
| 102 | 85 | 93 | 100 | Comparative Example |
| 103 | 103 | 118 | 95 | Present Invention |
| 104 | 104 | 122 | 92 | Present Invention |
| 105 | 104 | 120 | 91 | Present Invention |
| 106 | 113 | 127 | 88 | Present Invention |
| 107 | 112 | 128 | 86 | Present Invention |
| 108 | 113 | 127 | 88 | Present Invention |
| 109 | 127 | 140 | 78 | Present Invention |

In Table 4, sensitivities, grain characteristics, and pressure fogging of samples 101 to 109 are shown by values relative to the sensitivity of sample 101 (=100).

As shown in Example 1, the emulsion of the present invention had high sensitivity, good grain characteristics, and improved mar resistance.

What is claimed is:

1. A silver halide emulsion, comprising silver halide grains wherein 60 or more percent of the total area of all silver halide grains are occupied by tabular silver halide grains having a circle equivalent diameter of 0.6 μm or less, an aspect ratio of 1.5 or more, and having dislocation lines substantially localized only in the fringe portions thereof;

50 or more percent of the number of all silver halide grains are occupied by tabular silver halide grains having 10 or more dislocation lines per grain;

the surface silver iodide content of all silver halide grains is 3 mol % or less when analyzed by X-ray photoelectric spectroscopy (XPS); and the tabular silver halide grains are in a multilayer structure formed of phases with different silver iodide contents and wherein a phase with the lower iodide content of 3 mol % or less is formed at a pAg of 8.5 or less after a phase with the higher iodide content is formed.

2. The silver halide emulsion according to claim 1, wherein from 70 to 100 percent of the number of all silver halide grains are occupied by tabular silver halide grains having 10 or more dislocation lines per grain.

3. The silver halide emulsion according to claim 1, wherein the surface silver iodide content of all silver halide grains is 2.5 mol % or less when analyzed by X-ray photoelectric spectroscopy (XPS).

4. The silver halide emulsion according to claim 1, wherein tabular silver halide grains have a thickness from 0.05 to 1.0 μm.

5. The silver halide emulsion according to claim 1, wherein the pAg is from 6.0 to 8.0.

6. The silver halide emulsion according to claim 1, wherein the tabular silver halide grains are formed in the presence of a polyalkylene oxide block copolymer.

7. The silver halide emulsion according to claim 1, wherein said phase of lower iodide content has between 2.0 and 2.5 mol % silver iodide.

8. The silver halide emulsion according to claim 7, wherein from 70 to 100 percent of the number of said silver halide grains are tabular silver halide grains having 10 or more dislocation lines per grain.

9. The silver halide emulsion according to claim 7, wherein said tabular silver halide grains have a thickness from 0.05 to 1.0 μm.

10. The silver halide emulsion according to claim 7, wherein the pAg for formation of said phase with a lower iodide content is 7.5 or less.

11. The silver halide emulsion according to claim 10, wherein from 70 to 100 percent of the number of said silver halide grains are tabular silver halide grains having 10 or more dislocation lines per grain.

12. The silver halide emulsion according to claim 10, wherein said tabular silver halide grains have a thickness from 0.05 to 1.0 μm.

13. A photosensitive material comprising at least one blue sensitive, green sensitive and red sensitive silver halide emulsion layers, wherein at least one of said blue sensitive, green sensitive or red sensitive silver halide emulsion layers contains a silver halide emulsion, comprising silver halide grains wherein 60 or more percent of the total area of all silver halide grains are occupied by tabular silver halide grains having a circle equivalent diameter of 0.6 μm or less, an aspect ratio of 1.5 or more, and having dislocation lines substantially localized only in the fringe portions thereof;

50 or more percent of the number of all silver halide grains are occupied by tabular silver halide grains having 10 or more dislocation lines per grain;

the surface silver iodide content of all silver halide grains is 3 mol % or less when analyzed by X-ray photoelectric spectroscopy (XPS); and the tabular silver halide grains are in a multilayer structure formed of phases with different silver iodine contents and wherein a phase with the lower silver iodine content is formed at a pAg of 8.5 or less after a phase with the higher silver iodine content is formed.

14. The photosensitive material according to claim 13, wherein from 70 to 100 percent of the number of all silver halide grains are occupied by tabular silver halide grains having 10 or more dislocation lines per grain.

15. The photosensitive material according to claim 13, wherein the surface silver iodide content of all silver halide grains is 2.5 mol % or less when analyzed by X-ray photoelectric spectroscopy (XPS).

16. The photosensitive material according to claim 13, wherein tabular silver halide grains have a thickness from 0.05 to 1.0 $\mu$m.

17. The photosensitive material according to claim 13, wherein the pAg is from 6.0 to 8.0.

18. The photosensitive material according to claim 13, wherein the tabular silver halide grains are formed in the presence of a polyalkylene oxide block copolymer.

* * * * *